US010591850B2

(12) United States Patent
Hagiwara et al.

(10) Patent No.: US 10,591,850 B2
(45) Date of Patent: Mar. 17, 2020

(54) IMAGE FORMING APPARATUS HAVING A PROCESSOR CIRCUIT THAT CONTROLS AN AMOUNT OF DISCHARGE OF ULTRA FINE PARTICLES DISCHARGED FROM THE IMAGE FORMING APPARATUS, AND RELATED METHOD

(71) Applicant: CANON KABUSHIKI KAISHA, Tokyo (JP)

(72) Inventors: Hiroshi Hagiwara, Suntou-gun (JP); Takashi Yano, Mishima (JP); Tetsuya Sano, Mishima (JP); Noriaki Sato, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/052,007

(22) Filed: Aug. 1, 2018

(65) Prior Publication Data

US 2019/0049880 A1 Feb. 14, 2019

(30) Foreign Application Priority Data

Aug. 9, 2017 (JP) ..... 2017-154731

(51) Int. Cl.
*G03G 15/20* (2006.01)
*G03G 21/20* (2006.01)

(52) U.S. Cl.
CPC ..... *G03G 15/20* (2013.01); *G03G 15/2017* (2013.01); *G03G 15/2042* (2013.01);
(Continued)

(58) Field of Classification Search
None
See application file for complete search history.

(56) References Cited

U.S. PATENT DOCUMENTS 9,207,588 B2 12/2015 Nishida et al.
9,429,886 B2 8/2016 Minagawa et al.
(Continued)

FOREIGN PATENT DOCUMENTS

JP 2012-128330 A 7/2012
JP 2014-092718 A 5/2014
(Continued)

OTHER PUBLICATIONS

JP_2014102287_A_T Machine Translation, Japan, 2014.*
(Continued)

*Primary Examiner* — Victor Verbitsky
(74) *Attorney, Agent, or Firm* — Venable LLP

(57) ABSTRACT

An image forming apparatus includes a fixing device, a temperature sensor that detects a temperature of an end of the fixing device, and a blower unit that supplies air to the end of the fixing device to cool the end of the fixing device. In addition, a processor circuit is configured to control a cooling level by the blower unit in accordance with the temperature of the end of the fixing device detected by the temperature sensor, to predict, based on a parameter depending on the cooling level, a discharge amount of ultra fine particles that are discharged from the image forming apparatus, and to control an image forming operation by the image forming apparatus such that the discharge amount of ultra fine particles is reduced in accordance with the discharge amount predicted by the processor circuit.

13 Claims, 17 Drawing Sheets

(52) U.S. Cl.
CPC ..... *G03G 21/20* (2013.01); *G03G 21/206* (2013.01); *G03G 2215/00772* (2013.01)

(56) References Cited

U.S. PATENT DOCUMENTS

| | | | | |
|---|---|---|---|---|
| 2013/0243453 | A1* | 9/2013 | Horie | G03G 21/206 399/44 |
| 2014/0056608 | A1* | 2/2014 | Miura | G03G 15/205 399/92 |
| 2014/0286665 | A1 | 9/2014 | Minagawa et al. | |
| 2014/0314437 | A1 | 10/2014 | Nishida et al. | |

FOREIGN PATENT DOCUMENTS

| | | | | |
|---|---|---|---|---|
| JP | 2014102287 | A | * | 6/2014 |
| JP | 2015-068928 | A | | 4/2015 |
| JP | 2015-118242 | A | | 6/2015 |
| JP | 2016-014821 | A | | 1/2016 |
| JP | 2017-097036 | A | | 6/2017 |
| WO | 2017/115877 | A | | 7/2017 |

OTHER PUBLICATIONS

JP_2016014821_A_T MachineTranslation, Japan, Takada.*
Extended European Search Report dated Mar. 27, 2019, issued in European Application No. 18184140.4.

* cited by examiner

FIG 5A

| | | THRESHOLD[°C] | |
|---|---|---|---|
| SHEET WIDTH [mm] | CONVEYANCE SPEED | DOWN | UP |
| 149 OR LESS | FULL SPEED | 140 | 150 |
| | HALF SPEED | 130 | 140 |
| 149.1~210 | FULL SPEED | 170 | 180 |
| | HALF SPEED | 155 | 165 |
| 210.1~279.3 | FULL SPEED | 185 | 195 |
| | HALF SPEED | 170 | 180 |
| 279.4~297 | FULL SPEED | 240 | 250 |
| | HALF SPEED | 205 | 215 |
| 297.1~320 | FULL SPEED | 240 | 250 |
| | HALF SPEED | 205 | 215 |

FIG 5B

| | COOLING LEVEL 0 | | COOLING LEVEL 1 | | COOLING LEVEL 2 | | COOLING LEVEL 3 | |
|---|---|---|---|---|---|---|---|---|
| SHEET WIDTH [mm] | OPENING AMOUNT | AIR FLOW | OPENING AMOUNT | AIR FLOW | OPENING AMOUNT | AIR FLOW | OPENING AMOUNT | AIR FLOW |
| 149 OR LESS | 0mm | 0% | 70mm | 100% | 70mm | 100% | 70mm | 100% |
| 149.1~210 | 0mm | 0% | 42mm | 100% | 42mm | 100% | 42mm | 100% |
| 210.1~279.3 | 0mm | 0% | 2mm | 25% | 7mm | 50% | 13mm | 100% |
| 279.4~297 | 0mm | 0% | 1mm | 25% | 2mm | 50% | 4mm | 100% |
| 297.1~320 | 0mm | 0% | 0mm | 0% | 0mm | 0% | 0mm | 0% |

FIG 5C

| | Cx | | | | |
|---|---|---|---|---|---|
| OPENING AMOUNT X [mm] | 0 | 0<x≤13 | 13<x | k1 | k2 |
| NO TEMPERATURE CONTROL | 20 | | | 0.025 | 0.003 |
| TEMPERATURE CONTROL (NOT PAPER FEEDING) | 145 | 140 | 130 | 0.025 | 0.003 |
| FULL SPEED PAPER FEEDING | 140 | 135 | 130 | 0.016 | 0.003 |
| HALF SPEED PAPER FEEDING | 130 | 125 | 120 | 0.016 | 0.003 |

| SHUTTER | COOLING FAN | UFP DISCHARGE AMOUNT RATIO Rx |
|---|---|---|
| OPEN | DRIVE | 1.2 |
| OPEN | STOP | 1 |
| CLOSE | DRIVE | 1 |
| CLOSE | STOP | 1 |

| | COOLING LEVEL | | | |
|---|---|---|---|---|
| | Lv0 | Lv1 | Lv2 | Lv3 |
| CONVEYANCE INTERVAL EXTENSION TIMES [msec] | 0 | 500 | 1000 | 15000 |

IMAGE FORMING APPARATUS HAVING A PROCESSOR CIRCUIT THAT CONTROLS AN AMOUNT OF DISCHARGE OF ULTRA FINE PARTICLES DISCHARGED FROM THE IMAGE FORMING APPARATUS, AND RELATED METHOD

This application claims the benefit of Japanese Patent Application No. 2017-154731, filed Aug. 9, 2017, which is hereby incorporated by reference herein in its entirety.

BACKGROUND OF THE INVENTION

Field of the Invention

The present invention relates to control of an amount of discharge of ultra fine particles that are discharged from an image forming apparatus.

Description of the Related Art

Image forming apparatuses, such as copying machines and printers, have a heat-type fixing apparatus that causes an image to be fixed to a sheet. It is known that ultra fine particles (hereafter abbreviated to UFP) may be produced from such a fixing apparatus. UFPs are produced by wax, comprised in a developer, evaporating. Japanese Patent Laid-Open No. 2014-92718 has proposed reducing the fixing temperature and reducing the printing medium conveyance speed in accordance with the UFP discharge amount in order to suppress the UFP discharge amount.

In general, measurement devices for measuring a UFP discharge amount are expensive. Accordingly, it is difficult to provide an image forming apparatus with a measurement device. Accordingly, image forming apparatuses predict the UFP discharge amount. If the predicted discharge amount is less than the actual discharge amount, however, a large number of UFPs will be discharged. If the predicted discharge amount is greater than the actual discharge amount, the sheet conveyance speed will be slower than necessary, and image formation productivity will be reduced.

SUMMARY OF THE INVENTION

According to one aspect, the present invention provides an image forming apparatus that includes a fixing device configured to fix, by adding heat and pressure to a toner image formed on a sheet, the toner image to the sheet, a temperature sensor configured to detect a temperature of an end of the fixing device in a direction perpendicular to a sheet conveyance direction, a cooling device configured to cool the end of the fixing device, a cooling controller configured to control a cooling level by the cooling device in accordance with the temperature of the end of the fixing device detected by the temperature sensor, a prediction unit configured to predict, based on a parameter depending on the cooling level, a discharge amount of ultra fine particles that are discharged from the image forming apparatus, and an image formation controller configured to control an image forming operation by the image forming apparatus such that the discharge amount of ultra fine particles is reduced in accordance with the discharge amount predicted by the prediction unit.

Further features of the present invention will become apparent from the following description of exemplary embodiments with reference to the attached drawings.

BRIEF DESCRIPTION OF THE DRAWINGS

FIGS. 5A to 5D are views for describing tables, and the like.

DESCRIPTION OF THE EMBODIMENTS

Exemplary embodiments of the present invention will be described hereafter, with reference to the drawings. Note, the following embodiments are examples and the present invention is not limited to the content of the embodiments.

First Embodiment

Figure 1:
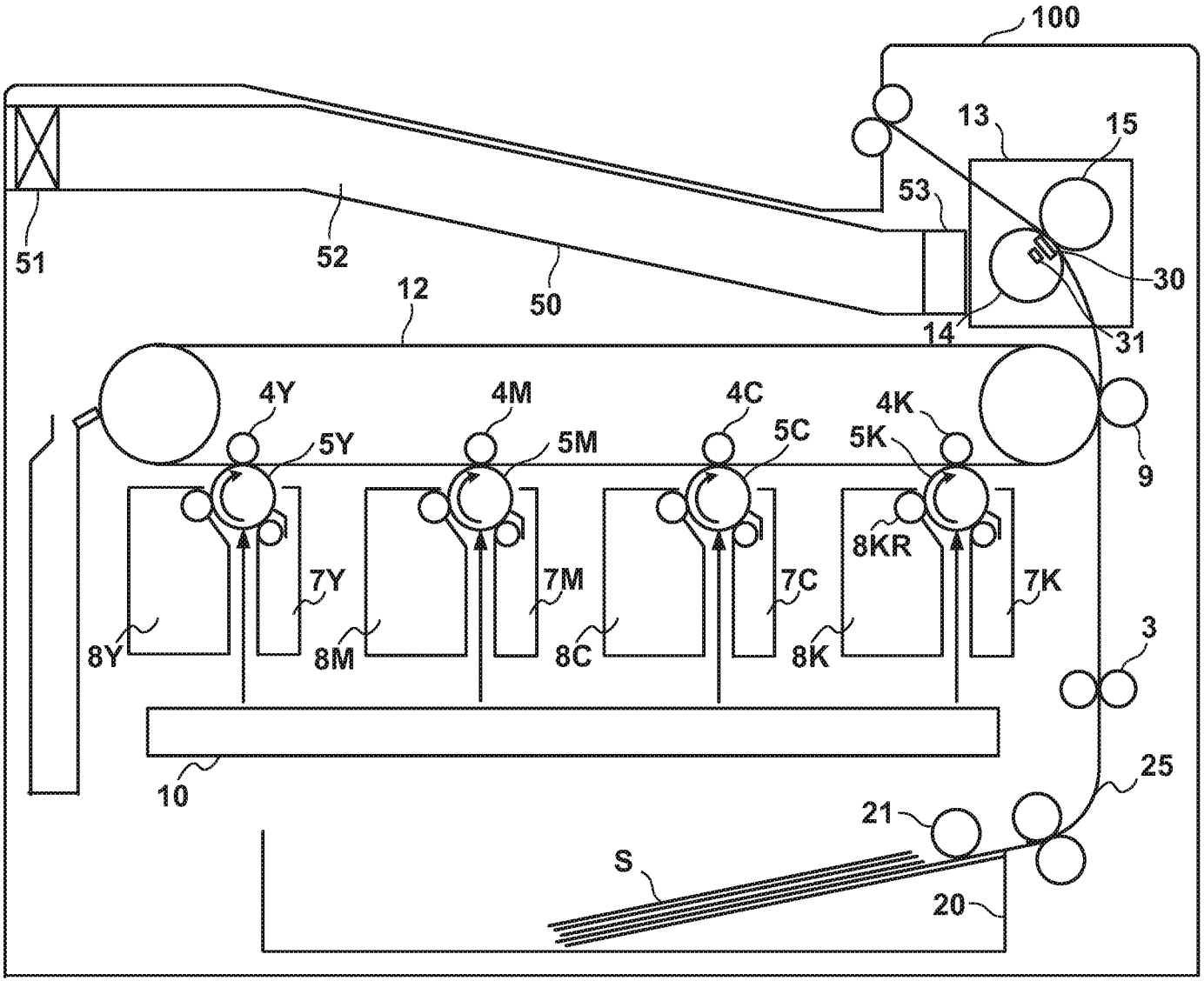
FIG. 1 is a figure illustrating an image forming apparatus.

As illustrated in FIG. 1, an image forming apparatus 100 is an electrophotographic printer. An image forming section, which may also be referred to as a printer engine, has four stations for forming a full color image. The four stations form images by using toner of respectively different colors. In FIG. 1, the characters Y, M, C, and K mean yellow, magenta, cyan, and black, respectively, which are toner colors. Note that when matters that are common to the four colors are described, the characters Y, M, C, and K will be omitted from the reference numeral. A charging apparatus 7 causes a photosensitive drum 5 to be uniformly charged. An optical section 10 outputs a laser beam according to an image signal. By the laser beam scanning the surface of the photosensitive drum 5, an electrostatic latent image is formed. A developing apparatus 8 forms a toner image by developing an electrostatic latent image by causing toner to adhere to the electrostatic latent image. A primary transfer apparatus 4 transfers a toner image that is carried on the surface of the photosensitive drum 5 to an intermediate transfer member 12. The intermediate transfer member 12 conveys the toner image to the secondary transfer section by rotating. A feed cassette 20 houses sheets S. A feed roller 21 feeds a sheet S housed in the feed cassette 20 to a conveyance path 25. A registration roller 3 conveys the sheet S to a secondary transfer section. A secondary transfer roller 9 is provided at the secondary transfer section. The secondary transfer roller 9, in cooperation with the intermediate transfer member 12, nips the sheet S while conveying it. Thereby, the toner image that was conveyed by the intermediate transfer member 12 is transferred to the sheet S. The sheet S is conveyed to a fixing apparatus 13.

The fixing apparatus 13, while conveying the sheet S, adds heat and pressure to the sheet S and the toner image. Thereby, the toner image is fixed to the sheet S. The fixing apparatus 13 comprises a fixing roller 14 and a pressure roller 15. Because the fixing roller 14 is hollow, it is also referred to as a fixing film. In the inside of the fixing roller 14, a fixing heater 30 and a temperature sensor 31 for detecting the temperature thereof are provided. The fixing heater 30 is controlled so that the temperature of the fixing heater 30 becomes a target temperature.

On the left side of the fixing apparatus 13 in FIG. 1, a cooling mechanism 50 that cools both ends of the fixing roller 14 is provided. The cooling mechanism 50 comprises a cooling fan 51 that introduces air from the exterior of the image forming apparatus 100, a duct 52 that conveys the air, and a shutter 53.

Figure 2A:
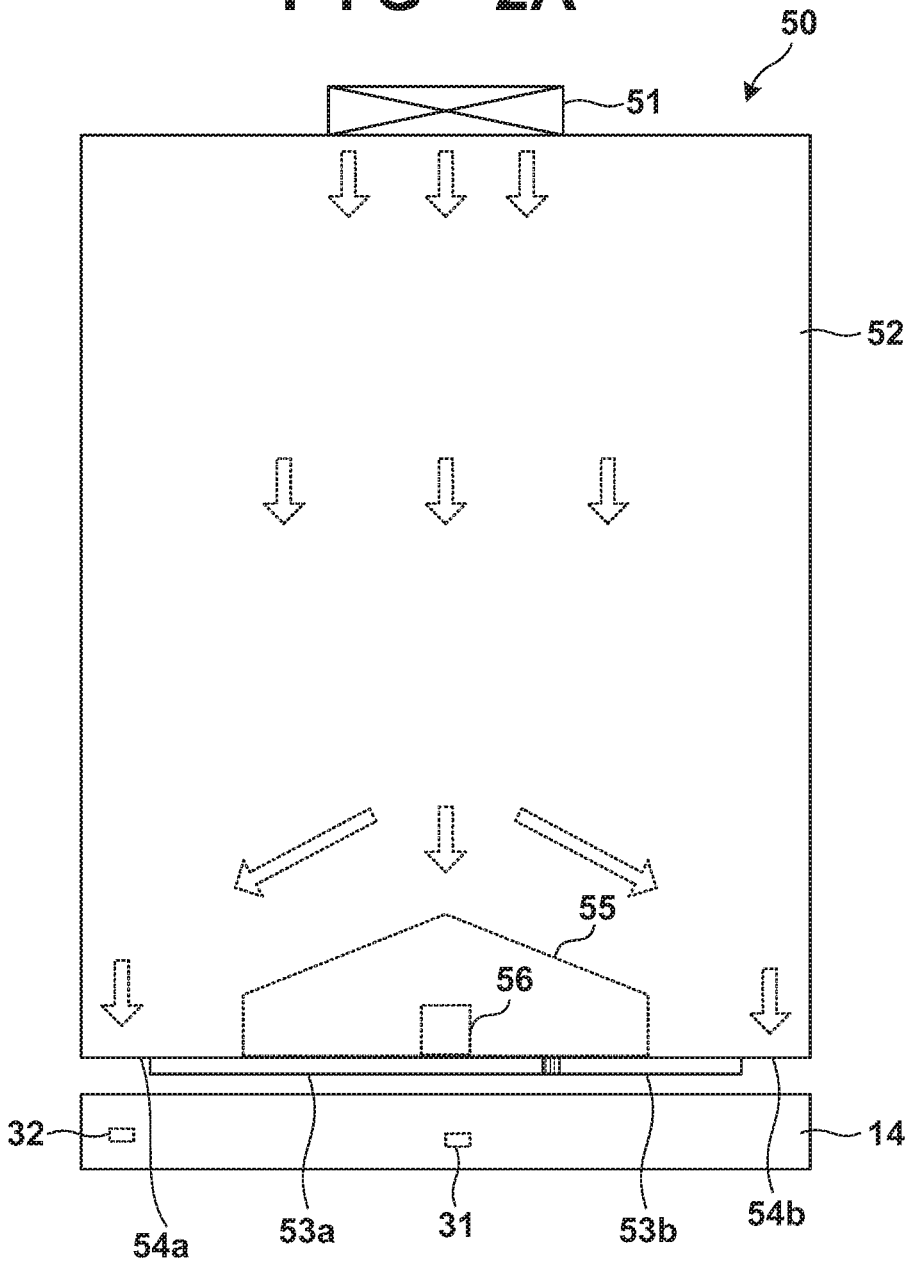
FIGS. 2A and 2B are views for describing a cooling mechanism.
Figure 2B:
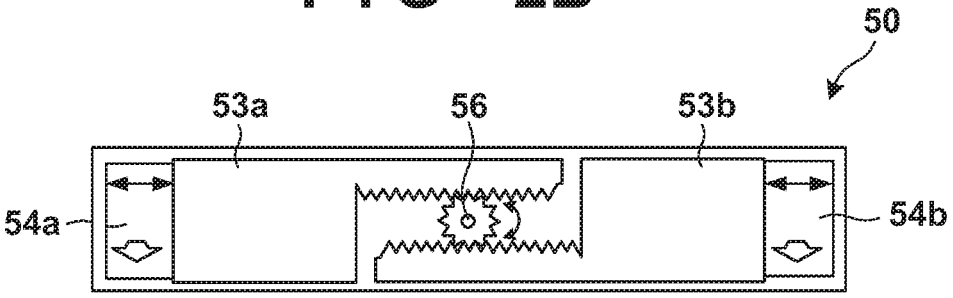

FIG. 2A is a plan view of the cooling mechanism 50. FIG. 2B is a side view of the cooling mechanism 50 when looking at the cooling mechanism 50 from the fixing apparatus 13. The cooling fan 51 is provided at the entrance of the duct 52. The arrow symbols indicate the flow of air. Inside the duct 52, a guide member 55 for guiding the air to a left opening 54*a* and a right opening 54*b* of the duct 52 is provided.

As FIG. 2B illustrates, a left shutter 53*a* and a right shutter 53*b* are provided at the exit of the duct 52. The left shutter 53*a* and the right shutter 53*b* move by the motor 56 rotating. When the left shutter 53*a* moves to the left, the area of the left opening 54*a* is reduced. When the left shutter 53*a* moves to the right, the area of the left opening 54*a* is increased. When the right shutter 53*b* moves to the left, the area of the right opening 54*b* is increased. When the right shutter 53*b* moves to the right, the area of the right opening 54*b* is reduced. The area of the left opening 54*a* and the area of the right opening 54*b* are adjusted accordingly.

The image forming apparatus 100 conveys the sheet S, centering it in the conveyance path. If the width of the sheet S is narrow, the left end and the right end of the fixing roller 14 do not contact the sheet S. Specifically, only the central portion of the fixing roller 14 contacts the sheet S. Heat is stolen from the central portion by the sheet S, but heat tends not to be stolen from the left end and the right end of the fixing roller 14. For this reason, the cooling mechanism 50 must cool the left end and the right end of the fixing roller 14. Note that the central portion is also referred to as a sheet passing portion and the left end and right end are referred to as a non-sheet passing portion. As FIG. 2A illustrates, a temperature sensor 32 is provided on the left end of the fixing roller 14. The temperature sensor 32 abuts the inner circumferential surface of the fixing roller 14, and detects the temperature of the left end of the fixing roller 14. Because the temperature of the left end and the temperature of the right end of the fixing roller 14 correlate, it is sufficient that the temperature sensor 32 be provided at only one of the left end and the right end of the fixing roller 14.

Control Section

Figure 3A:
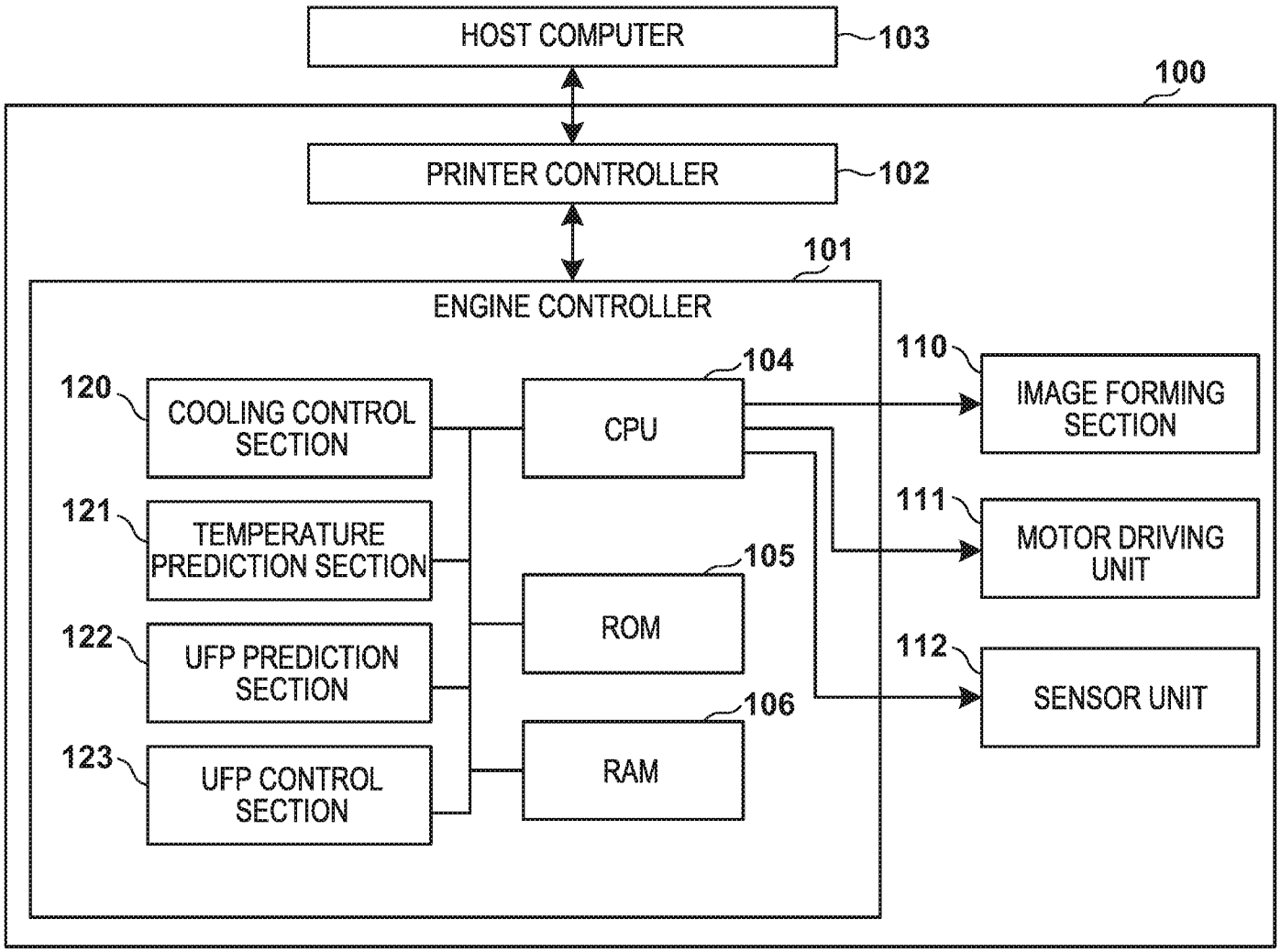
FIGS. 3A and 3B are views for illustrating a control section.

FIG. 3A illustrates a control section of the image forming apparatus 100. An engine controller 101 comprises a central processing unit (CPU) 104, a read only memory (ROM) 105, and a random access memory (RAM) 106, or the like. The CPU 104 is a processor circuit that controls each section of the image forming apparatus 100 by executing a control program stored in the ROM 105. The ROM 105 is a non-volatile storage apparatus. The RAM 106 is a volatile storage apparatus for storing variables, or the like. An image forming section 110 is the fixing apparatus 13 described above, or the like. A motor driving section 111 drives a conveyance roller, the pressure roller 15, or the like, which are provided on the conveyance path 25. The motor driving section 111 drives the cooling fan 51 and the motor 56. A sensor section 112 includes the temperature sensors 31 and 32.

A print controller 102 is connected to the engine controller 101 and a host computer 103. The print controller 102 converts image data into bitmap data in accordance with a print job input from the host computer 103, executes image processing, such as tone correction, and generates an image signal. The print controller 102 transmits an image signal to the engine controller 101 in synchronization with a TOP signal transmitted from the engine controller 101.

A cooling control section 120 controls an air flow amount and an opening amount of the cooling mechanism 50. A temperature prediction section 121 predicts an ambient temperature of the fixing apparatus 13. A UFP prediction section 122 predicts a UFP discharge amount. A UFP control section 123 controls a UFP discharge amount. This may be implemented as hardware, such as an application specific integrated circuit (ASIC), and may be implemented by the CPU 104 executing a control program.

Figure 3B:
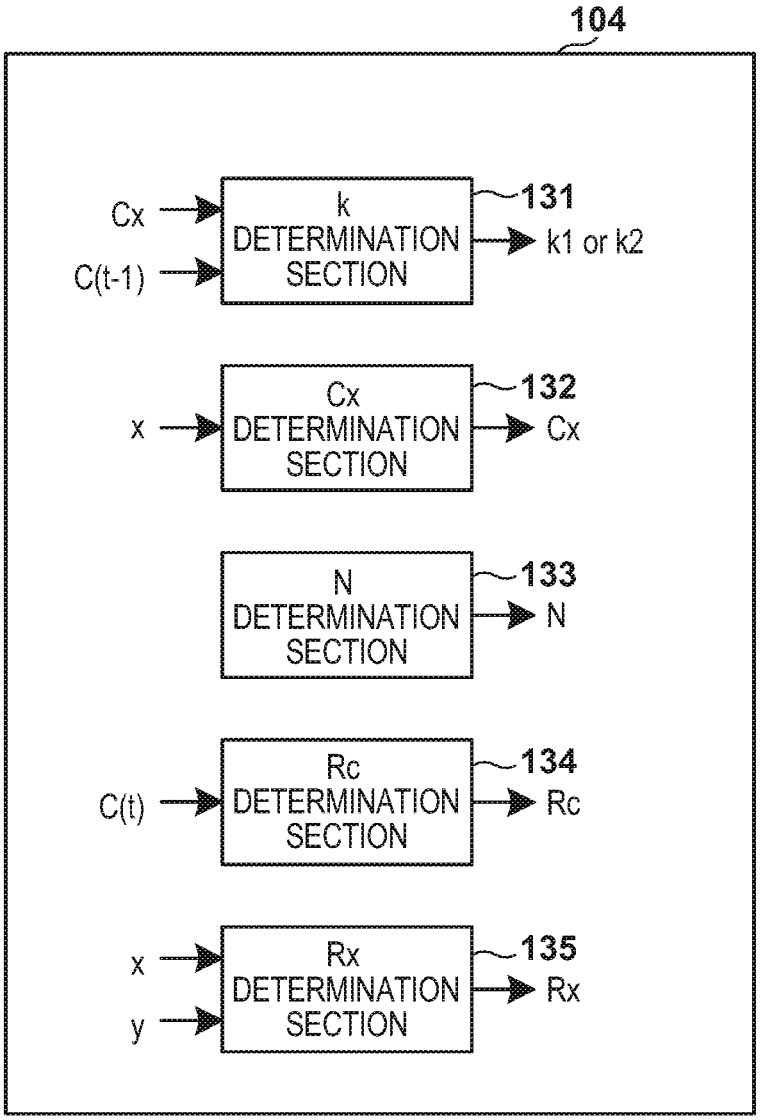

FIG. 3B indicates a function that is realized by the CPU 104 executing a control program. A k determination section 131 determines a temperature coefficient k based on a convergence temperature Cx, or the like, and supplies it to the temperature prediction section 121. The convergence temperature Cx is a convergence temperature of the ambient temperature C(t). A Cx determination section 132 determines the convergence temperature Cx based on an opening amount x. An N determination section 133 determines a number of sheets subjected to image formation per unit time based on the conveyance speed of the sheet S, and supplies it to the UFP prediction section 122. An Rc determination section 134 determines a UFP discharge ratio Rc based on the ambient temperature C(t) obtained by the temperature prediction section 121, and supplies it to the UFP prediction section 122. An Rx determination section 135 determines a UFP discharge ratio Rx based on the opening amount x and the air flow amount y, and supplies it to the UFP prediction section 122. Note that the detailed meaning of these parameters will be described below. These functions may be realized by hardware, such as an ASIC or a field-programmable gate array (FPGA).

Cooling Control Section Operation

Figure 4:
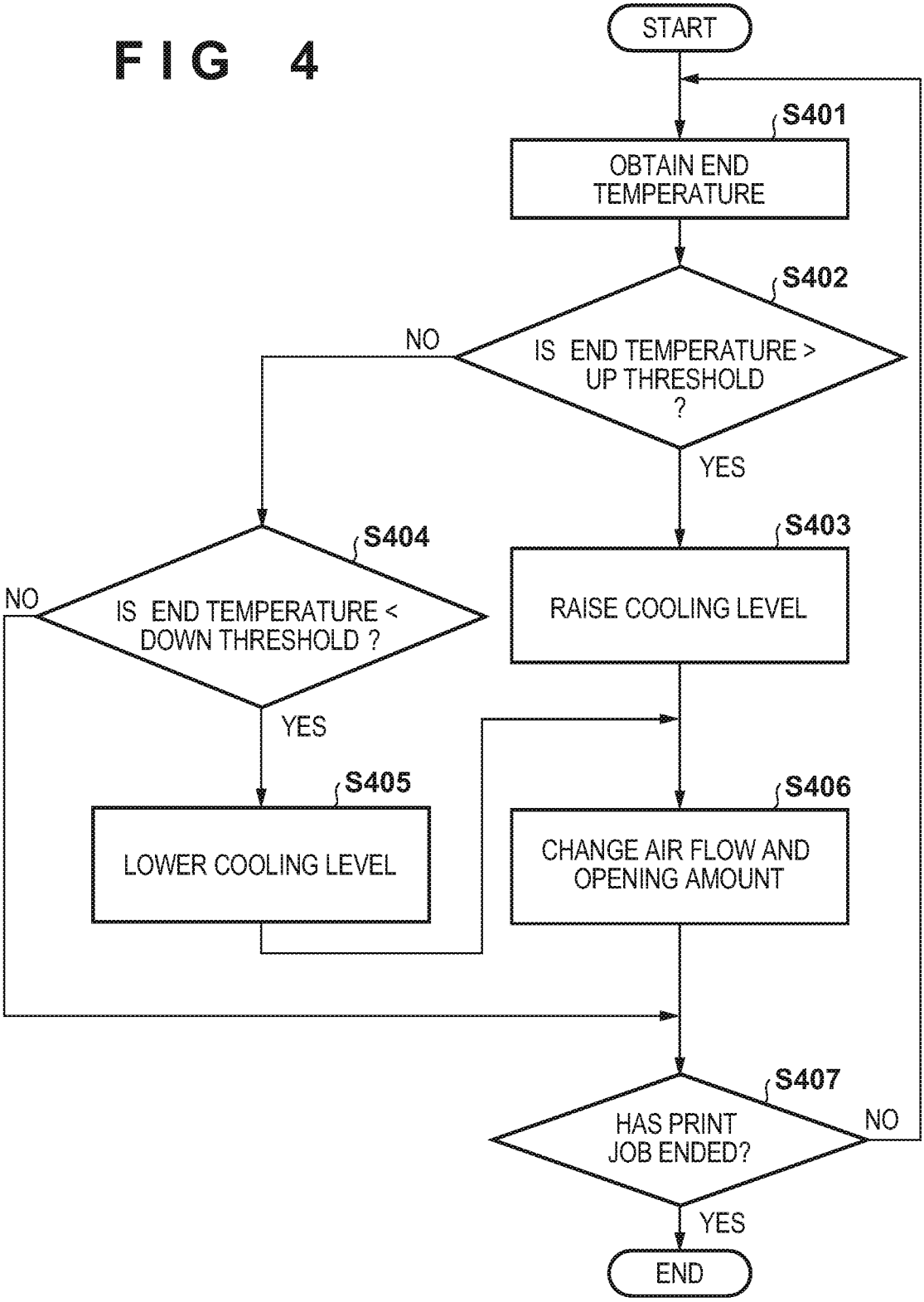
FIG. 4 is a flowchart for describing cooling control.

FIG. 4 illustrates an operation of the cooling control section 120. The engine controller 101 activates the cooling control section 120 when it receives a print instruction from the print controller 102. In step S401, the cooling control section 120 obtains an end temperature Te of the fixing roller 14 from the temperature sensor 32. In step S402, the cooling control section 120 determines whether or not the end temperature Te exceeds an UP threshold Tup. If the end temperature Te exceeds the UP threshold Tup, the cooling control section 120 advances to step S403. If the end temperature Te does not exceed the UP threshold Tup, the cooling control section 120 advances to step S404.

In step S403, the cooling control section 120 raises the cooling level. As an example, the cooling level takes values from 0 to 3. The initial value of the cooling level is 0. Next, the cooling control section 120 advances to step S406.

In step S404, the cooling control section 120 determines whether or not the end temperature Te falls below a DOWN threshold Tdown. If the end temperature Te does not fall below the DOWN threshold Tdown, the cooling control section 120 advances to step S407. If the end temperature Te falls below the DOWN threshold Tdown, the cooling control section 120 advances to step S405.

In step S405, the cooling control section 120 lowers the cooling level. After that, the cooling control section 120 advances to step S406.

In step S406, the cooling control section 120 changes the air flow amount y of the cooling fan 51 and the opening amount x of the shutter 53 in accordance with the cooling level. When the shutter 53 is positioned at a home position, the shutter 53 blocks the opening 54 completely. Specifically, the opening amount x at the home position is 0. The cooling control section 120 causes the motor 56 to rotate such that the opening amount x of the shutter 53 becomes the opening amount x according to the cooling level. The relationship between the opening amount x and the amount of rotation of the motor 56 is tabulated in advance, and is stored in the ROM 105. Specifically, the cooling control section 120 obtains the opening amount x from the cooling level, and obtains the amount of rotation corresponding to the opening amount x from the ROM 105. Note that configuration may be taken such that a home position sensor that detects that the shutter 53 is positioned at the home position is added.

In step S407, the cooling control section 120 determines that the print job based on the print instruction has ended. If the print job has not ended, the cooling control section 120 returns to step S401.

FIG. 5A illustrates the DOWN threshold Tdown and the UP threshold Tup according to combinations of sheet widths and conveyance speeds. The sheet width is the length of the sheet S in a direction perpendicular to the sheet conveyance direction. A rate of increase of the temperature of the end of the fixing roller 14 differs depending on the sheet width. Also, the rate of increase in the temperature differs depending on the sheet conveyance speed. Accordingly, the DOWN threshold Tdown and the UP threshold Tup are tabulated in advance in accordance with the combinations of sheet width and conveyance speed, and are stored in the ROM 105. The CPU 104 or the cooling control section 120 analyzes the print job, obtains a combination of the sheet width and the conveyance speed, reads a threshold corresponding to the combination from the table, and sets it to the cooling control section 120.

FIG. 5B illustrates the relationship between sheet width and cooling level. Since the rate of increase in the temperature of the end of the fixing roller 14 differs depending on the sheet width, the opening amount x and the air flow amount y are determined in advance in accordance with the sheet width. The relationship between the sheet width and the cooling level is also tabulated in advance, and is stored in the ROM 105. The cooling control section 120 obtains the opening amount x and the air flow amount y from the table in the ROM 105 in accordance with the sheet width and the cooling level.

By the foregoing control, it is possible to maintain the temperature in the central portion of the fixing apparatus 13 at a target temperature, and to cool the ends.

Temperature Prediction Section Operation

The temperature prediction section 121 predicts an ambient temperature C(t) of the fixing apparatus 13 and provides it to the UFP prediction section 122, or the like. Below, this prediction process is described in detail.

In the present embodiment, an increasing curve and a decreasing curve of the ambient temperature C(t) in a case in which the image forming apparatus 100 is caused to operate, and the convergence temperature Cx at which the temperature increase stops are measured by experimentation in advance under various conditions. The following prediction equation is obtained from the measured curves and convergence temperature Cx. Reference t is an integer type variable indicating time, and its unit is seconds. This means that C(t) is predicted for every second.

$$C(t)=C(t-1)+k(Cx-C(t-1)) \quad (1)$$

Here, C(t−1) is the ambient temperature predicted the previous time (one second previous). Cx is the convergence temperature corresponding to the current operation state of the image forming apparatus 100 obtained by experimentation in advance. Reference k is a temperature curve coefficient.

FIG. 5C illustrates an example of parameters used in prediction of the ambient temperature. For the temperature curve coefficient k, there is an increasing curve coefficient k1 and a decreasing curve coefficient k2. In a case in which the previous ambient temperature C(t−1) is greater than the convergence temperature Cx, the k determination section 131 selects the increasing curve coefficient k1. In a case in which the previous ambient temperature C(t−1) is less than the convergence temperature Cx, the k determination section 131 selects the decreasing curve coefficient k2. The Cx determination section 132 determines the convergence temperature Cx based on an opening amount x. The temperature prediction section 121, when the power of the image forming apparatus 100 is input, computes the ambient temperature C(t) by using Equation (1) in one second intervals. The initial value C(t=0) of the ambient temperature may be a 20° C. room temperature, which is envisioned in advance. Alternatively, the temperature of the environment in which the image forming apparatus 100 is installed may be detected by a thermistor, and the detected environmental temperature may be substituted into the initial value C(0) of the ambient temperature.

As FIG. 5C illustrates, the convergence temperature Cx changes depending on the operation state of the image forming apparatus 100 and the opening amount x of the shutter 53. The reference "no temperature control" indicates that control of the temperature of the fixing apparatus 13 is stopped. Specifically, "temperature control (not paper feeding)" indicates that power is being supplied to the fixing heater 30, and that the fixing temperature of the fixing apparatus 13 is being controlled to a target temperature. In this operation state, however, the sheet S does not pass through the fixing apparatus 13. The reference "full speed paper feeding" is an operation state in which the sheet S conveyance speed is set to 100%. The reference "half speed paper feeding" is an operation state in which the sheet S conveyance speed is set to 50%. The table that FIG. 5C illustrates is stored in the ROM 105. The Cx determination section 132 may reference this table, and determine the convergence temperature Cx corresponding to the combination of the opening amount x and the operation state of the image forming apparatus 100.

Figure 5D:
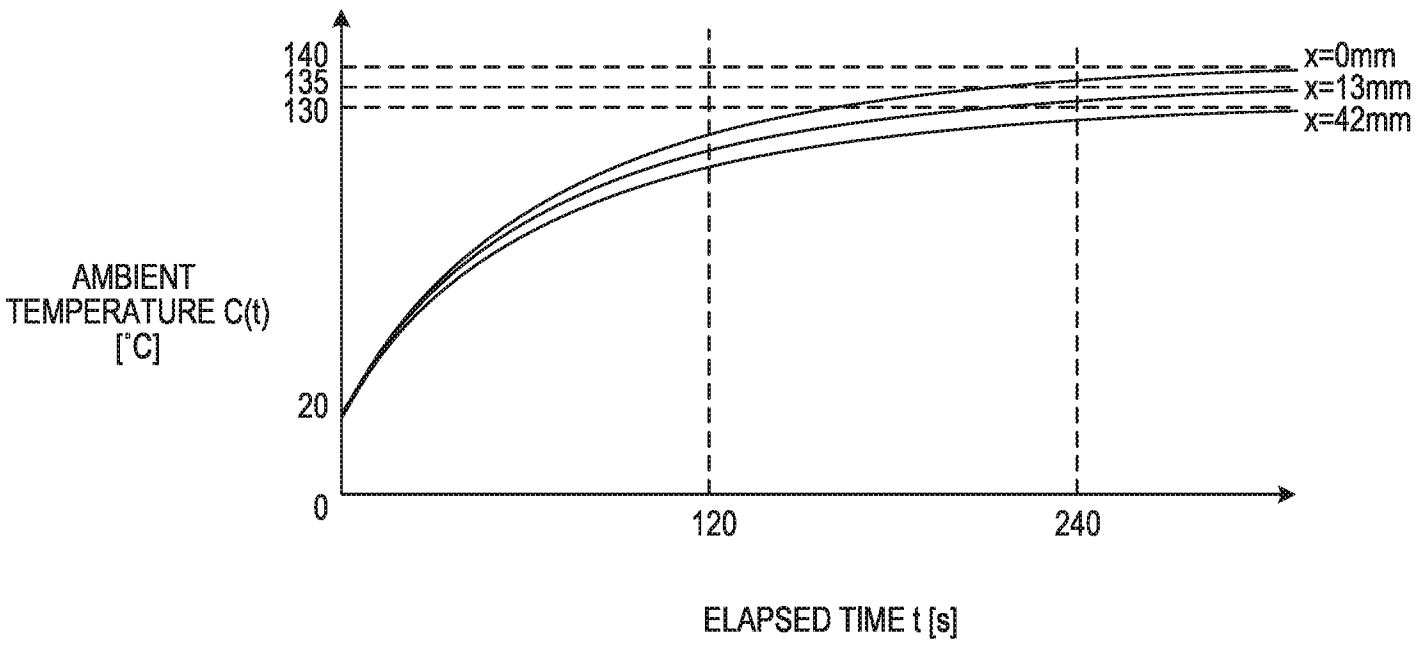

FIG. 5D illustrates prediction results for the ambient temperature C(t) during full speed paper feeding for the opening amount x. The prediction result for the ambient temperature C(t) changes depending on the opening amount x. Also, it can be seen that the ambient temperature C(t) converges to the convergence temperature Cx, which corresponds to the opening amount x.

UFP Prediction Section Operation

Figures 6A, 6B:
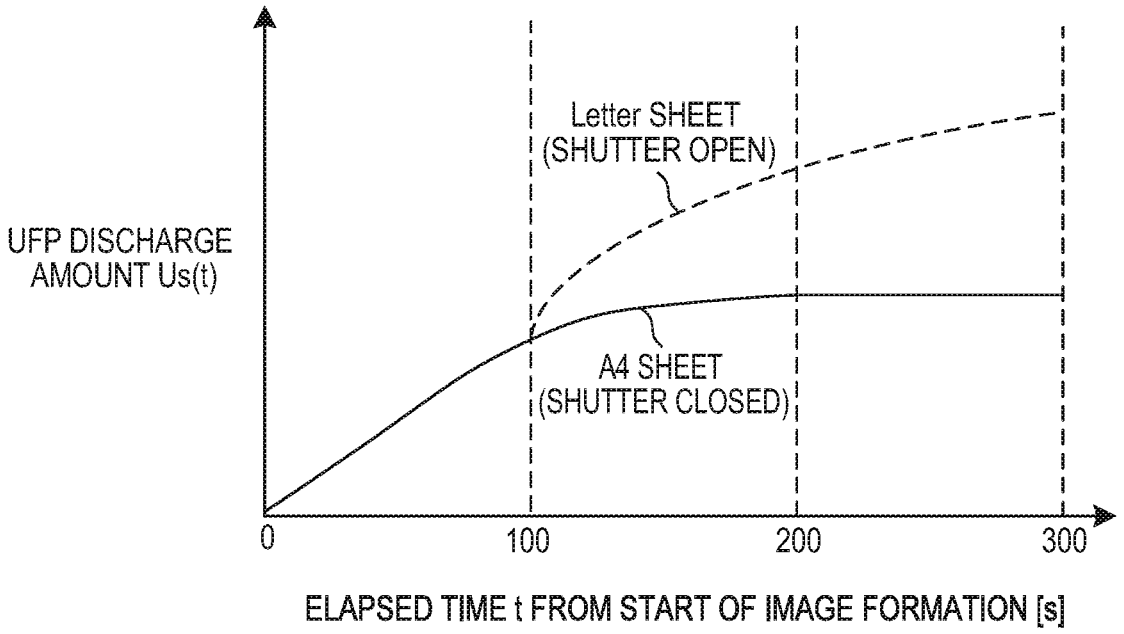
FIGS. 6A to 6D are views for describing relationships between respective parameters.

In the present embodiment, the UFP discharge amount Us(t) is treated as a unit-less relative value. FIG. 6A illustrates a relationship between an elapsed time t from the start of an image formation operation and a UFP discharge amount Us(t). It is assumed that the ambient temperature C(t) at the image formation operation start time approximately matches the temperature of the environment. The sheet S conveyance speed is set to full speed. Here, the UFP discharge amount Us(t) of an A4 sheet (sheet width of 297 mm) and a UFP discharge amount Us(t) of a Letter sheet (sheet width of 279.4 mm) are illustrated. With a Letter sheet, when approximately 100 seconds has elapsed since the start of the image formation operation, the cooling control section 120 opens the shutter 53. The UFP discharge amount Us(t) for the two types of sheets S is the same until the shutter 53 is opened. After the shutter 53 opens, however, the UFP discharge amount Us(t) for a Letter sheet increases more than the UFP discharge amount Us(t) for an A4 sheet. When the shutter 53 opens, the convergence of the UFP discharge amount Us(t) becomes slow and the UFP discharge amount Us(t) increases.

The following two reasons can be considered for the UFP discharge amount Us(t) being influenced by the opening amount x of the shutter 53. The first reason is that the flow of air in the periphery of the fixing apparatus 13 differs between the case in which the shutter 53 is closed and the case in which it is open, and for the UFPs produced by the fixing apparatus 13, the amount that stops inside the image forming apparatus 100 and the amount that are discharged to the outside differs. The second reason is that the ambient temperature C(t) tends not to rise when the shutter 53 is open and outside air is supplied to the periphery of the fixing apparatus 13. The reasons that the ambient temperature C(t) influences the UFP discharge amount Us(t) are that when the ambient temperature C(t) increases by a certain amount, the UFPs tend to adhere to members in the periphery of the fixing apparatus 13, and the amount of UFPs that are discharged to the outside is reduced. Also, as the UFPs become integrated with each other, the particle size of the UFPs becomes larger, and the number of UFPs per unit volume decreases.

In this way, the UFP discharge amount Us(t) is greatly influenced by the opening amount x of the shutter 53 and the ambient temperature C(t). Accordingly, the UFP prediction section 122 predicts the UFP discharge amount Us(t) by using the opening amount x of the shutter 53 and the ambient temperature C(t). Thereby, the prediction accuracy for the UFP discharge amount Us(t) improves.

Figure 6C:
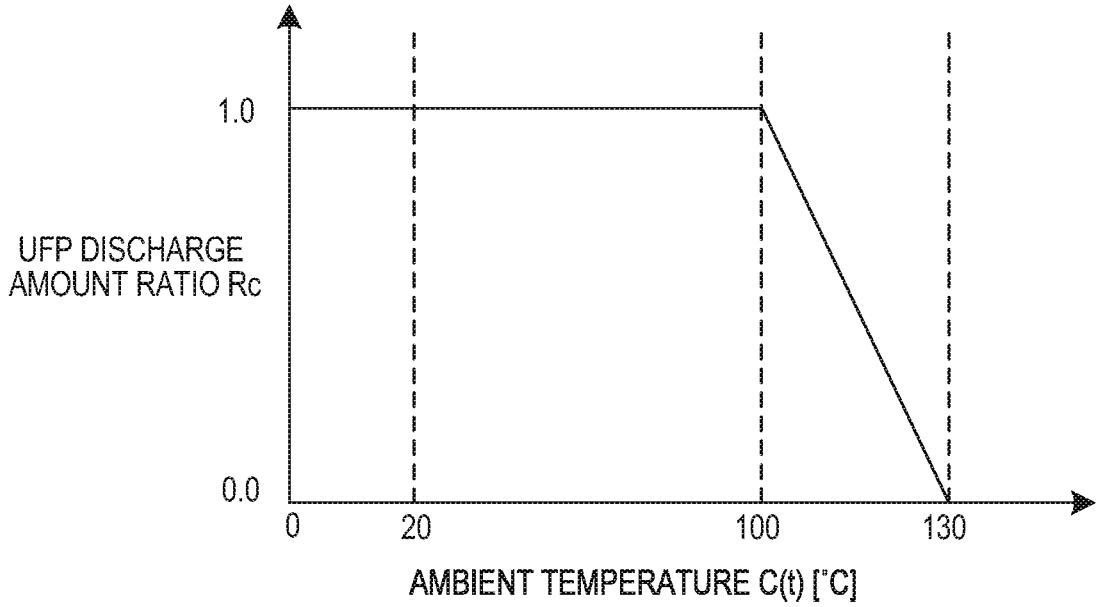

In the present embodiment, by experimentation in advance, the UFP discharge amount per sheet S is obtained, and the UFP discharge amount is determined to be a reference value. The UFP discharge amount at that time may be normalized to 1. The experimentation is started in a state in which the shutter 53 is closed and the ambient temperature C(t) is substantially corresponding to the room temperature. The size of the sheet S was A4. The conveyance speed was full speed. Also, the experimentation was performed with different combinations of the opening amount x of the shutter 53 and the ambient temperature C(t) when measurement starts. The ratios Rx and Rc for the UFP discharge amount in relation to the reference value were obtained. FIG. 6B illustrates the ratio Rx obtained based on a combination of opening/closing the shutter 53 and driving/stopping the cooling fan 51. FIG. 6C illustrates the ratio Rc relative to the ambient temperature C(t).

In a case in which the conveyance speed is set to half speed, the target temperature of the fixing heater 30 decreases, and the toner wax volatile matter decreases. Accordingly, the UFP discharge amount at half speed is less than the UFP discharge amount at full speed. Accordingly, in the present embodiment, to simplify control, the UFP discharge amount in the case in which the conveyance speed is half speed is assumed to be 0. In the present embodiment, the target temperature of the fixing heater 30 at full speed is 180° C., and the target temperature at half speed is 160° C.

An equation for predicting the UFP discharge amount Us(t) that uses the parameters obtained by the above experimentation is as follows.

$$Us(t)=Us(t-1)+N\times Rc\times Rx \quad (2)$$

Here, Us(t−1) indicates the discharge amount predicted the previous time (one second previous). N indicates the number of sheets subjected to image formation that was performed in the most recent 1 second, and is obtained by the N determination section 133. Rx is the UFP discharge ratio obtained by the Rx determination section 135 based on the combination of the air flow amount y and the opening amount x from the table illustrated in FIG. 6B. Rc is the UFP discharge ratio obtained by the Rc determination section 134 based on the ambient temperature C(t) from the table illustrated in FIG. 6C. The UFP prediction section 122, when the power of the image forming apparatus 100 is input, computes the UFP discharge amount Us(t) in accordance with Equation (2) in one second intervals.

Figure 6D:
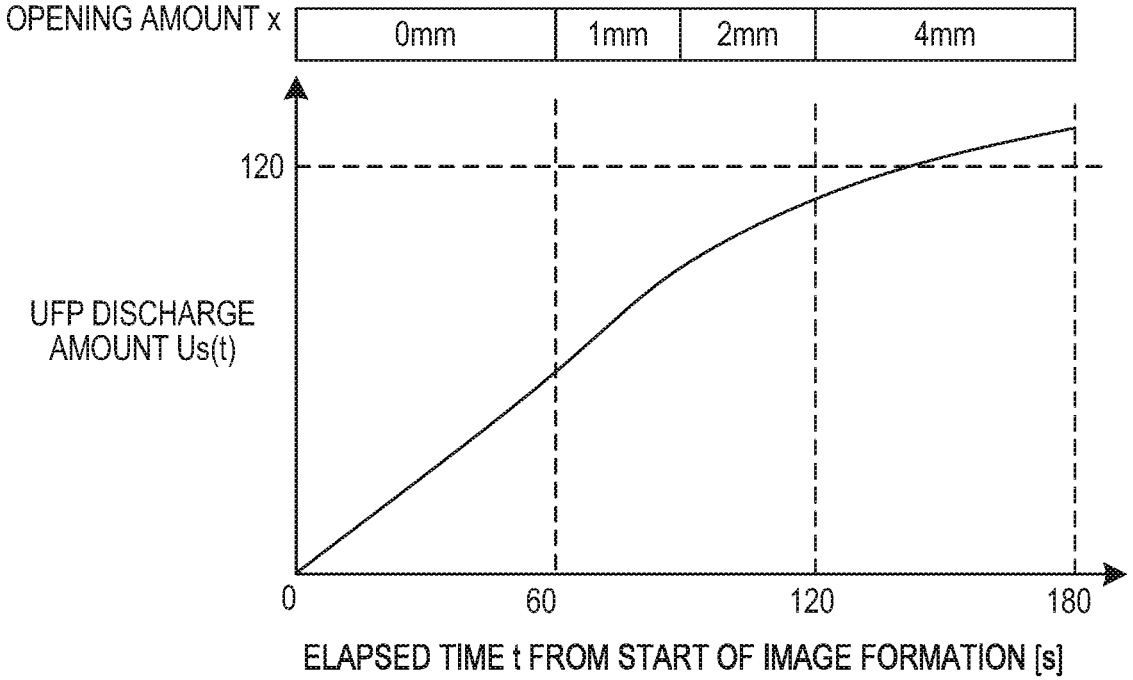

FIG. 6D illustrates prediction results for the UFP discharge amount Us(t). The conveyance speed was set to full speed, and the size of the sheet S was A4. Throughput was 60 ppm, where ppm indicates the number of sheets subjected to image formation in one minute. In this example, the cooling level is changed from 0 to 1 when 60 seconds has elapsed from when the image formation operation started. The cooling level is changed from 1 to 2 when 90 seconds has elapsed. The cooling level is changed from 2 to 3 when 120 seconds has elapsed. The opening amount x of the shutter 53 switches from 0 mm, 1 mm, 2 mm, and 4 mm in accordance with the table illustrated in FIG. 5B. Because the UFP discharge amount Us(t) is predicted by using the control state of the cooling mechanism 50 in this way, it is thought that the prediction accuracy of the UFP discharge amount Us(t) will improve.

UFP Control Section Operation

Figure 7A:
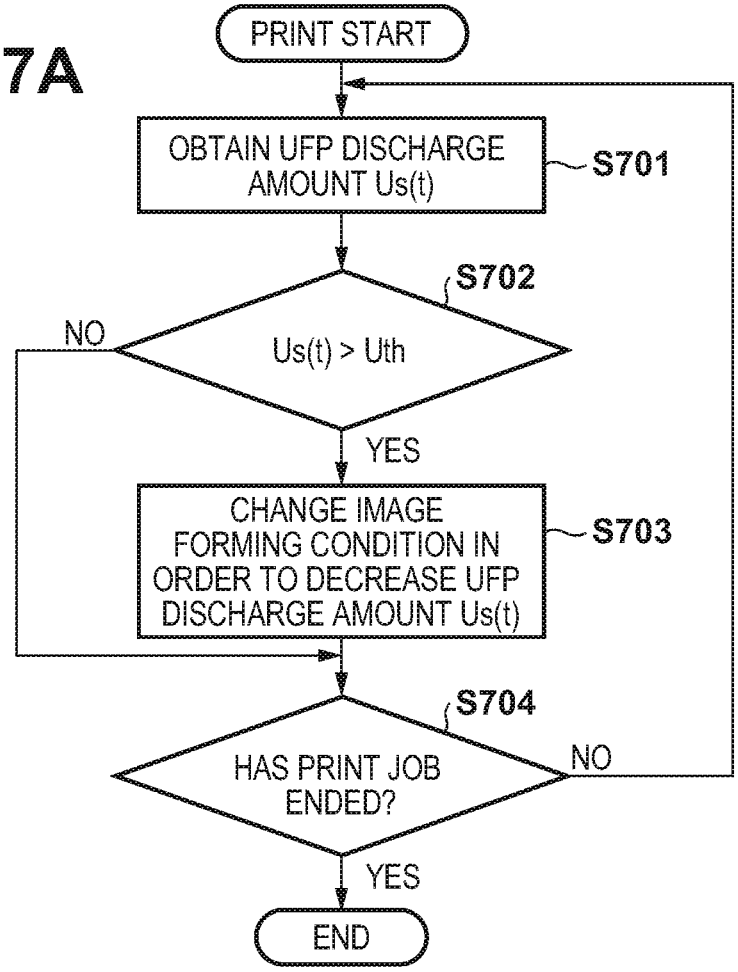
FIG. 7A is a flowchart for describing discharge reduction.

FIG. 7A illustrates operation of the UFP control section 123. The engine controller 101 activates the UFP control section 123 when it receives a print instruction from the print controller 102.

In step S701, the UFP control section 123 obtains the UFP discharge amount Us(t), which is the current prediction result from the UFP prediction section 122.

In step S702, the UFP control section 123 determines whether or not the UFP discharge amount Us(t) exceeds the threshold Uth. If the UFP discharge amount Us(t) exceeds the threshold Uth, the UFP control section 123 advances to step S703. Meanwhile, if the UFP discharge amount Us(t) does not exceed the threshold Uth, the UFP control section 123 skips step S703 and advances to step S704.

In step S703, the UFP control section 123 changes the image forming condition such that the UFP discharge amount Us(t) decreases. For example, the UFP control section 123 switches the conveyance speed from full speed to half speed, and changes the target temperature of the fixing heater 30 from 180° C. to 160° C.

In step S704, the UFP control section 123 determines whether or not the print job has ended. The UFP control section 123 repeatedly executes from step S701 to step S704 until the print job ends.

When the image forming condition is changed, the UFP discharge amount is substantially 0. Accordingly, it becomes possible to reduce the UFP discharge amount Us(t) to be less than or equal to the threshold Uth. Note that the threshold Uth is determined from the reference value for the UFP discharge amount per one A4 sheet of the image forming apparatus 100 and the absolute value of the UFP discharge amount, which is made to be the upper limit.

Figure 7B:
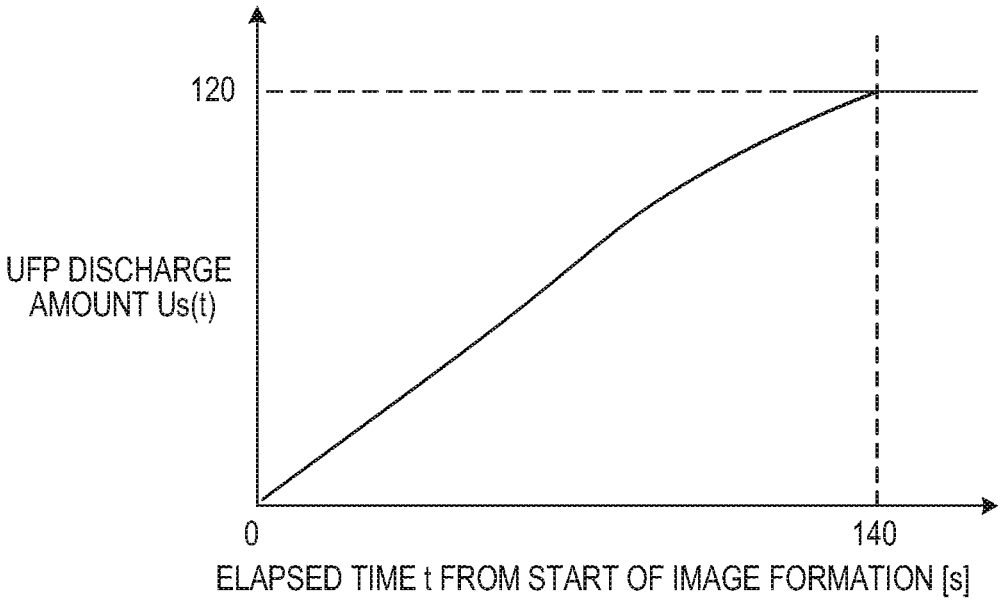
FIG. 7B is a view illustrating experimental results.

FIG. 7B illustrates an example of an operation for reducing the UFP discharge amount. Here, the threshold Uth of the UFP discharge amount is set to 120. In accordance with FIG. 7B, the conveyance speed is switched, according to the operation for reducing the UFP discharge amount, from full speed to half speed at the point in time when approximately 140 seconds have elapsed from when the image formation operation started. Thereby, it can be seen that the UFP discharge amount Us(t) is reduced to the threshold Uth or less.

In this way, in the first embodiment, the UFP discharge amount Us(t) is predicted based on the ambient temperature C(t) and the cooling level of the cooling mechanism 50. Since the UFP discharge amount Us(t) is predicted taking into consideration the influence of the cooling mechanism 50 on the UFP discharge amount Us(t), the prediction accuracy improves. In conditions in which the UFP discharge amount Us(t) is large, a UFP reduction operation is executed. Thereby, the amount of UFP discharge is reduced. In conditions in which the UFP discharge amount is small, a normal image formation operation is executed. Accordingly, image formation productivity is maintained.

Second Embodiment

In the first embodiment, the cooling level of the cooling mechanism 50 is controlled in accordance with the end temperature Te of the fixing apparatus 13. In the second embodiment, control for cooling the end of the fixing apparatus 13 in which the UFP discharge amount Us(t) is also taken into consideration is employed. This is advantageous in maintaining the conveyance speed. In the second embodiment, a description of matters that are common to or similar to the first embodiment is omitted.

In the second embodiment, a control mode in which an increase in the end temperature Te is reduced by controlling the conveyance interval between two adjacent sheets S is added to the UFP control section 123. Below, the control mode in which the cooling mechanism 50 is used that is described in the first embodiment is referred to as the first mode, and the control mode in which an increase in the end temperature Te is reduced by controlling the conveyance interval is referred to as the second mode.

Second Mode

Figures 8A, 8B:
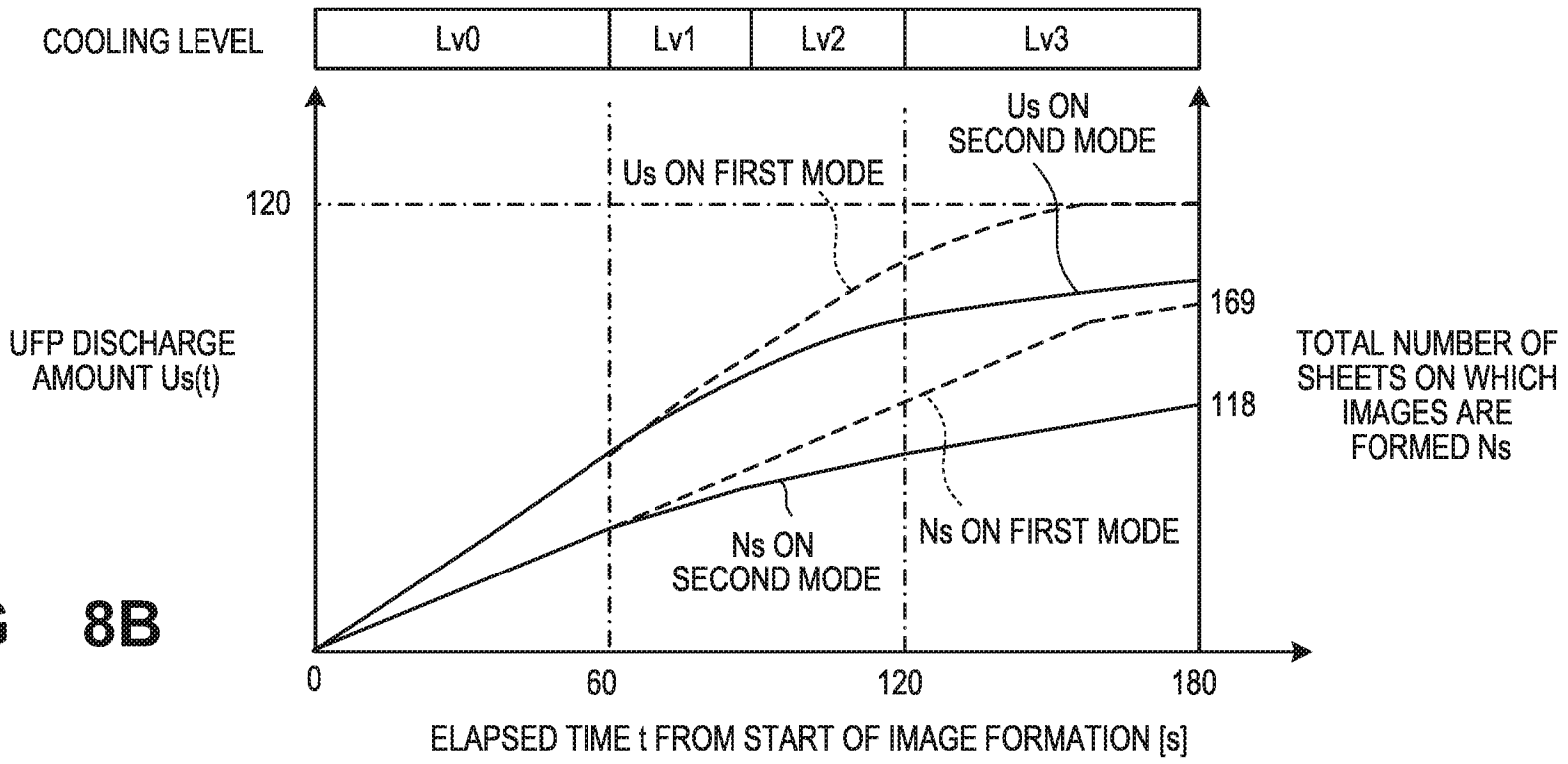
FIG. 8A is a view illustrating a conveyance interval table.
FIG. 8B is a view illustrating experimental results.

FIG. 8A illustrates conveyance interval extension times at each cooling level in the second mode. The relationship between the cooling levels and the conveyance interval extension times is tabulated and stored in the ROM 105. Here, the conveyance interval is defined to be the time interval from the time at which the trailing edge of the preceding sheet S passes through until the time at which the leading edge of the subsequent sheet S passes through. In the second mode, the interval at which the fixing heater 30 is caused to operate is widened by widening the conveyance interval of the sheets S that pass through the fixing apparatus 13. Thereby, an increase in the temperature of the ends is reduced. The method of determining the cooling level in the second embodiment is the same as the determination method in the first embodiment. As FIG. 8A illustrates, the extension time of the conveyance interval according to the cooling level increases.

FIG. 8B illustrates transitioning of the UFP discharge amount Us(t) and the total number of sheets subjected to image formation Ns for each control mode. The conveyance speed is set to full speed. The size of the sheet S is A4. The throughput is 60 ppm. The experimental results for the second mode are illustrated in solid lines. The experimental results for the first mode are illustrated in dashed lines. Here, the threshold Uth of the UFP discharge amount is set to 120. The cooling level is changed from 0 to 1 when 60 seconds has elapsed from the start of the image formation operation, is changed from 1 to 2 when 90 seconds has elapsed, and is changed from 2 to 3 when 120 seconds has elapsed.

The UFP discharge amount Us of the second mode converges to a value that is less than the UFP discharge amount Us of the first mode. Since the shutter 53 is always closed in the second mode, the UFP discharge ratio Rx is smaller. Furthermore, since the convergence temperature C(t) becomes high quickly, the UFP discharge ratio Rc is small. Formula (2) indicates that if Rx and Rc become smaller, the UFP discharge amount Us(t) becomes smaller.

In the first mode, since the UFP discharge amount Us(t) exceeds the threshold Uth when approximately 150 seconds have elapsed from when the image formation operation starts, the productivity falls from 60 ppm to 30 ppm due to a reduction of the UFP discharge amount. Since the UFP discharge amount Us(t) converges at less than the threshold Uth in the second mode, a reduction in the conveyance speed does not occur. Since the conveyance interval is widened in accordance with the cooling level, however, the productivity falls gradually (60 ppm⇒40 ppm⇒30 ppm⇒24 ppm). The productivity may be compared by the number Ns of sheets S on which an image is formed. At the point in time when 180 seconds have elapsed, the number of sheets Ns in the first mode is 159. The number of sheets Ns in the second mode is 118. Accordingly, the productivity of the first mode is greater than the productivity of the second mode.

In this way, the first mode has the merit of maintaining high productivity. The second mode has the merit of reducing the UFP discharge amount. In the second embodiment, either the first mode or the second mode is selected based on the UFP discharge amount Us(t).

Cooling Control Taking UFP Discharge Amount into Consideration

Figure 9A:
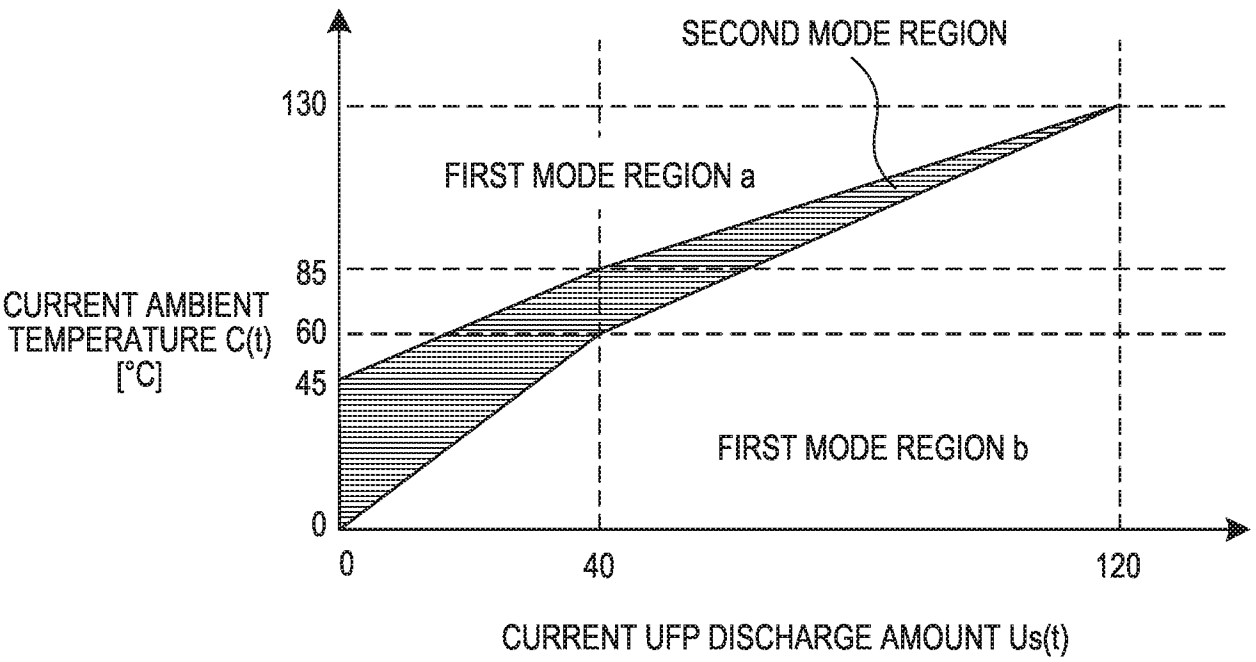
FIG. 9A is a view for describing control mode selection.

In the second embodiment, the temperature prediction section 121 and the UFP prediction section 122 execute the same processing as in the first embodiment. The threshold Uth of the UFP control section 123 is 120. FIG. 9A is a view for describing a selection formula Td for selecting the control mode. The selection formula Td selects either the first mode or a second mode based on the current UFP discharge amount Us(t) and the ambient temperature C(t). The selection formula Td is divided into three regions. The first mode region a is a region in which the first mode is selected in a case in which the ambient temperature C(t) is high. The first mode region b is a region in which the first mode is selected in a case in which the ambient temperature C(t) is low. The second mode region is a region in which the second mode is selected. The boundary between the respective regions is decided as follows.

The first mode region a is a region in which the UFP discharge ratio Rc becomes small since the ambient temperature C(t) is high. In this region, the UFP discharge amount Us converges without exceeding the threshold Uth regardless of which of the first mode and the second mode are used. Accordingly, by selecting the first mode, the productivity is kept high. In accordance with the selection formula Td, the region in which $Us<40$ and $Us+45\leq C$ is satisfied falls in the first mode region a. Also, the region in which $Us\geq 40$ and $0.56\times Us+62.6\leq C$ is satisfied falls under the first mode region a.

The first mode region b is a region in which the UFP discharge ratio Rc becomes large since the ambient temperature C(t) is small. Specifically, in the first mode region b, the UFP discharge amount Us exceeds the threshold Uth regardless of which of the first mode and the second mode are used. Accordingly, the first mode is selected, and the conveyance speed is reduced so that the UFP discharge amount Us becomes less than or equal to the threshold Uth. In accordance with the selection formula Td, the region in which $Us<40$ and $1.5\times Us\geq C$ is satisfied falls in the first mode region b. Also, the region in which $Us\geq 40$ and $0.88\times Us+24.8\geq C$ is satisfied falls under the first mode region b.

The region in which $Us<40$ and $Us+45>C>1.5\times Us$ is satisfied falls in the second mode region. Also, the region in which $Us\geq 40$ and $0.56\times Us+62.6>C>0.88\times Us+24.8$ is satisfied falls in the second mode region. In the second mode region, the UFP discharge amount Us may exceed the threshold Uth when the first mode is executed, but the UFP discharge amount Us converges without exceeding the threshold Uth when the second mode is executed. Accordingly, by selecting the second mode, the UFP discharge amount Us is reduced to less than or equal to the threshold Uth. In a case in which the second mode is transitioned into from the first mode, the second mode is maintained until the ambient temperature C(t) becomes the threshold Cth (for example: 130° C.) or more. Thereby, the effect of reducing the UFP discharge amount Us is enhanced.

Note that in the case in which the number of sheets on which an image is formed is small, the print job will likely end up being completed prior to the ambient temperature C(t) becoming high in a case in which the second mode is selected in accordance with the determination formula Td. In such a case, the effect of reducing the UFP discharge amount caused by the ambient temperature C(t) becoming high is not achieved much. There is the possibility that in spite of this productivity will greatly decrease. Accordingly, configuration may be taken such that if the number of sheets subject to image formation N designated by the job data of the print job is a predetermined value or less (for example: 120 sheets), the first mode is selected. Thereby, high productivity should be maintained.

Flowchart

Figure 9B:
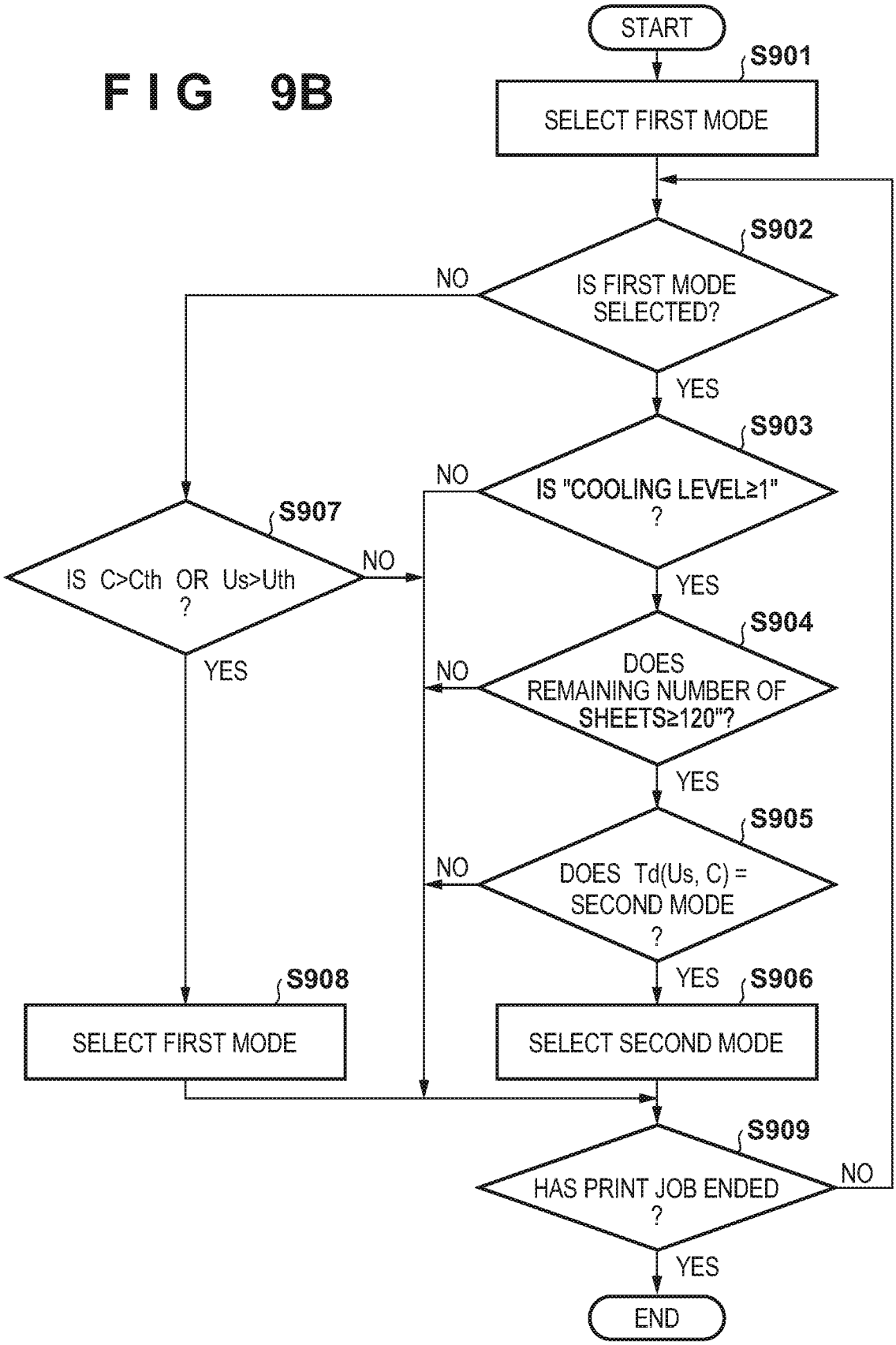
FIG. 9B is a flowchart for describing control mode selection.

FIG. 9B illustrates cooling control that takes the UFP discharge amount into consideration. The engine controller 101 activates the UFP control section 123 when it receives a print instruction from the print controller 102.

In step S901, the UFP control section 123 selects the first mode as the control mode.

In step S902, the UFP control section 123 determines whether or not the first mode is selected as the control mode. If the first mode is selected as the control mode, the UFP control section 123 advances to step S903 in order to determine whether or not it is necessary to switch from the first mode to the second mode. If the second mode has already been selected, the UFP control section 123 advances to step S907.

In step S903, the UFP control section 123 determines whether or not the cooling level is 1 or more. If the cooling level is not 1 or more, it is unnecessary to switch to the second mode, and, therefore, the UFP control section 123 advances to step S909. Meanwhile, if the cooling level is 1 or more, the UFP control section 123 advances to step S904.

In step S904, the UFP control section 123 determines whether or not the number of sheets that remain is a predetermined number or more (for example: 120 sheets). The number of sheets that remain is the number of sheets to be subjected to image formation for which image formation has not yet been completed out of the number of sheets to be subjected to image formation that was designated by the print job. The UFP control section 123 calculates the number of sheets that remain by counting the number of images that the image forming section 110 has formed, and subtracting the counted value from the number of sheets to be subjected to image formation designated by the print job. If the remaining number of sheets is less than a predetermined number, it is unnecessary to switch to the second mode, and, therefore, the UFP control section 123 advances to step S909. Meanwhile, if the remaining number of sheets is the predetermined number or more, the UFP control section 123 advances to step S905.

In step S905, the UFP control section 123, by using the selection formula Td, determines whether or not it is necessary to switch to the second mode based on the UFP discharge amount US(t) obtained by the UFP prediction section 122 and the ambient temperature C(t) obtained by the temperature prediction section 121. If the combination of the UFP discharge amount US(t) and the ambient temperature C(t) is inside the first mode regions a and b, the UFP control section 123 determines that it is unnecessary to switch to the second mode and advances to step S909. On the other hand, if the combination of the UFP discharge amount US(t) and the ambient temperature C(t) is inside the second mode region, the UFP control section 123 determines that it is necessary to switch to the second mode and advances to step S906.

In step S906, the UFP control section 123 selects the second mode, and advances to step S909. Specifically, the control mode is switched from the first mode to the second mode.

In step S907, the UFP control section 123 determines whether the current ambient temperature C(t) exceeds the threshold Cth, or whether the UFP discharge amount Us exceeds the threshold Uth. This is a logical OR condition. If the ambient temperature C(t) does not exceed the threshold Cth and the UFP discharge amount Us does not exceed the threshold Uth, the UFP control section 123 advances to step S909. On the other hand, if the ambient temperature C(t) exceeds the threshold Cth, the UFP control section 123 advances to step S908. Also, if the UFP discharge amount Us exceeds the threshold Uth, the UFP control section 123 advances to step S908. The threshold Cth is determined by experimentation in advance.

In step S908, the UFP control section 123 selects the first mode as the control mode. Specifically, the control mode is switched from the first mode to the second mode.

In step S909, the UFP control section 123 determines whether or not the print job has ended. The UFP control section 123 repeatedly executes from step S901 to step S909 until the print job ends.

Experimental Results

Figure 10:
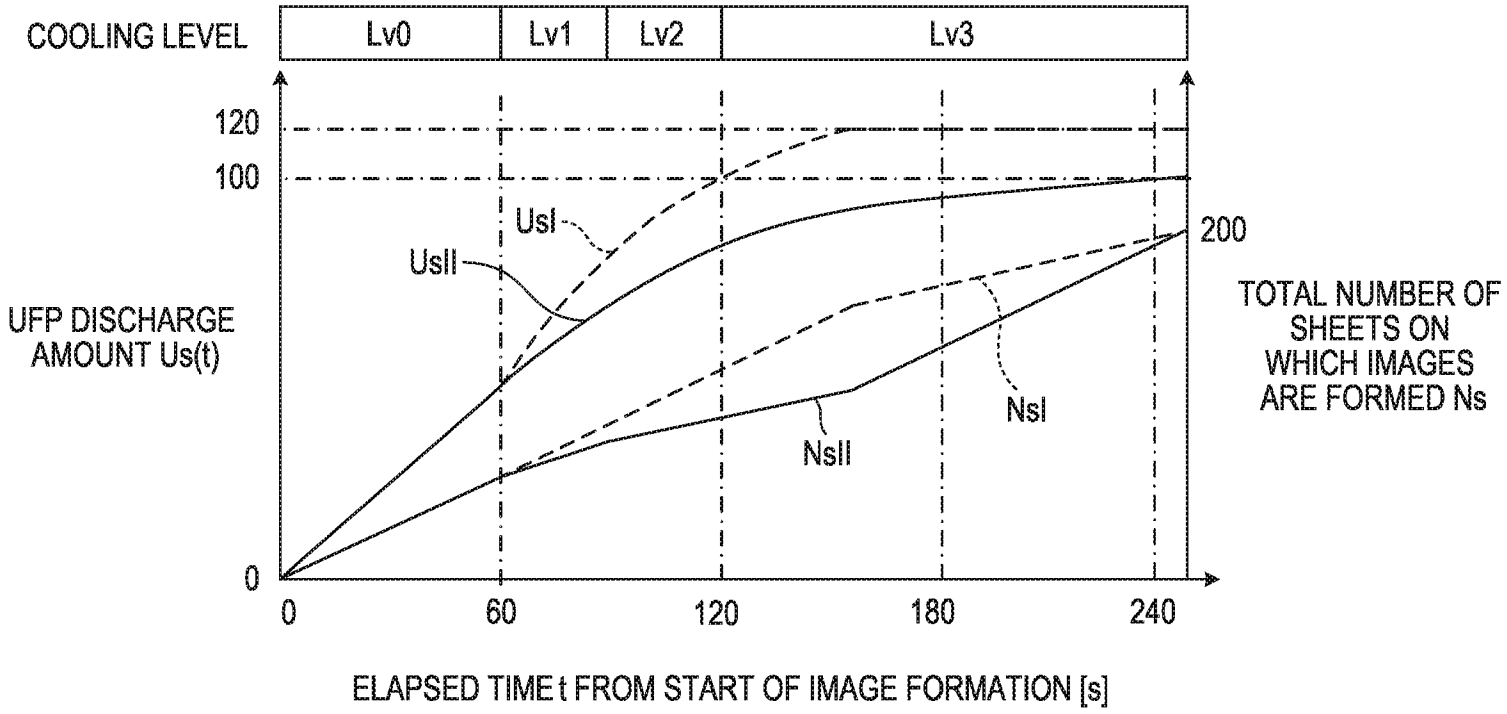
FIG. 10 is a view illustrating experimental results.

FIG. 10 illustrates experimental results for the first and second embodiments. Experimentation was carried out under the same conditions for the first embodiment and the second embodiment. UsI indicates the UFP discharge amount of the first embodiment. NsI indicates the total number of sheets on which images are formed for the first embodiment. UsII indicates the UFP discharge amount of the second embodiment. NsII indicates the total number of sheets on which images are formed for the second embodiment.

In the first embodiment, the first mode is always selected. When 60 seconds has elapsed from the start of the image formation operation, the cooling level becomes 1 or greater, and the shutter 53 opens. For that reason, the UFP discharge amount Us continues to increase. At the point in time when approximately 150 seconds have elapsed, the UFP control section 123 switches the conveyance speed to half speed.

In the second embodiment, the second mode is selected when the cooling level becomes 1 or greater. Accordingly, the conveyance interval widens, and productivity decreases. Meanwhile, a UFP discharge amount UsII is reduced to be lower compared to the UFP discharge amount UsI. When the ambient temperature C(t) exceeds the threshold Cth at the point in time when approximately 150 seconds has elapsed, the control mode switches to the first mode, and the productivity returns to what it was. At that point in time, the UFP discharge amount UsII has converged. Also, the UFP discharge amount UsII is reduced to be less than the UFP discharge amount UsI. When the total number of sheets subjected to image formation Ns exceeds 200 sheets (at the point in time when approximately 250 seconds has elapsed), the productivity of the second embodiment exceeds the productivity of the first embodiment. After that, the productivity of the second embodiment is greater than the productivity of the first embodiment. Accordingly, in the case in which the number of sheets on which images are to be formed is large, the second embodiment is advantageous in that the UFP discharge amount Us is reduced and high productivity can be achieved.

In this way, in the second embodiment, in a case of a condition in which the UFP discharge amount Us is large, the control mode is switched from the first mode to the second mode. Consequently, it becomes possible to reduce the UFP discharge amount US. The first mode is selected in the case in which the condition is the same for the UFP discharge amount Us regardless of which of the first mode and the second mode is selected. Thereby, high productivity is maintained. In the second embodiment, the method of widening the conveyance interval is employed as the second mode. In the case of an image forming apparatus 100 that has a conveyance speed that is between full speed and half speed (for example: ¾th speed), the conveyance speed may be reduced to ¾th speed together with widening the conveyance sheet interval.

Also, a simple formula for determining using only the ambient temperature C or only the UFP discharge amount Us may be used for the determination formula Td. For example, in the case in which only the ambient temperature C is used, the first mode region is determined if the ambient temperature is 85° C. or more, and the second mode region is determined otherwise, and, in the case in which only the UFP discharge amount Us is used, the first mode region is determined if the UFP discharge amount Us is 65 or more and the second mode region is determined otherwise.

Third Embodiment

In the third embodiment, the UFP discharge amount is reduced by starting the image formation operation after raising the ambient temperature C(t) prior to the start of the image formation operation. In the third embodiment, a description of matters that are common to or similar to the first and second embodiments is omitted.

Control of Fixing Temperature Taking into Consideration UFP Discharge Amount

The first mode region a of the determination formula Td illustrated in FIG. 9A indicates a condition in which the UFP discharge amount Us converges at a value less than the threshold Uth. Thus, if the image formation operation is started in a state in which the ambient temperature C(t) is positioned in the first mode region a, the UFP discharge amount Us is reduced without causing the conveyance speed to be lowered. Also, high productivity is maintained.

Flowchart

Figure 11A:
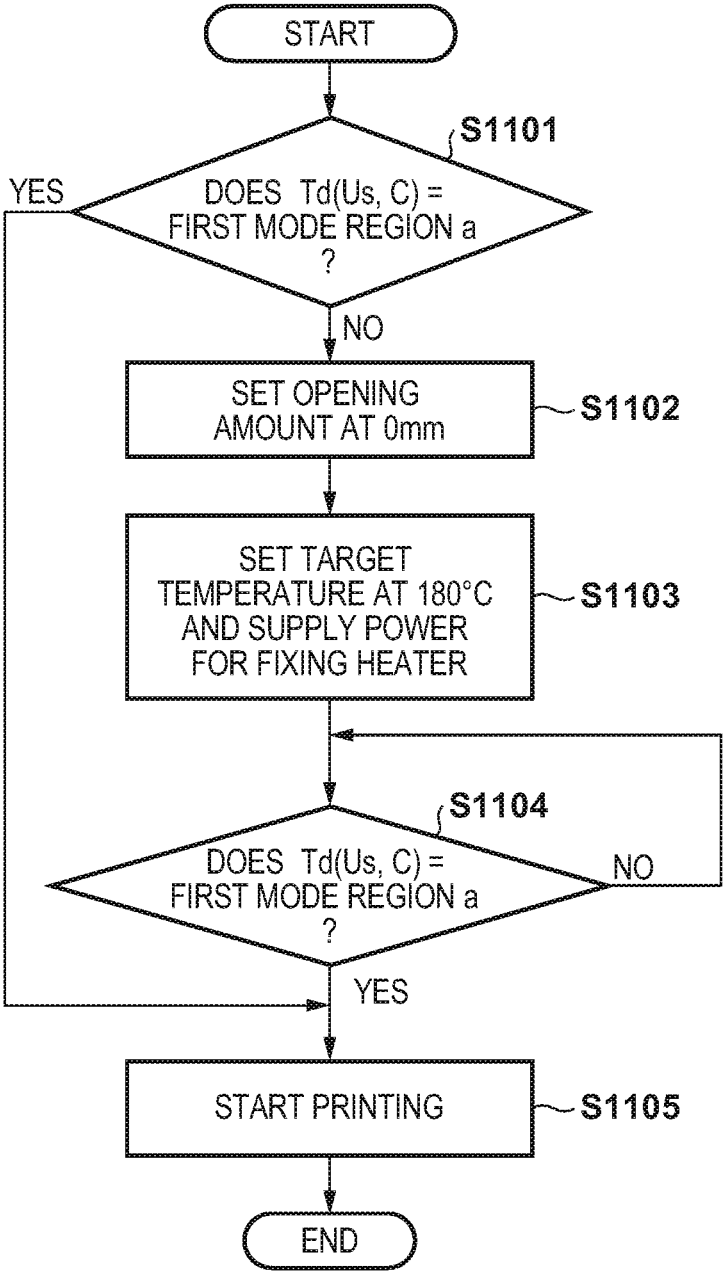
FIG. 11A is a flowchart for describing temperature control.

FIG. 11A illustrates temperature control for the fixing apparatus 13 that takes the UFP discharge amount into consideration. When the CPU 104 of the engine controller 101 receives a print instruction from the print controller 102, the CPU 104 starts temperature control for the fixing apparatus 13.

In step S1101, the CPU 104 uses the determination formula Td to determine whether or not the combination of the ambient temperature C(t) obtained by the temperature prediction section 121 and the UFP discharge amount Us(t) obtained by the UFP prediction section 122 is present in the first mode region a. If the combination of C(t) and Us(t) is positioned in the first mode region a, the CPU 104 skips step S1102 through step S1104, advances to step S1105, and starts printing. If the combination of C(t) and Us(t) is not positioned in the first mode region a, the CPU 104 advances to step S1102.

In step S1102, the CPU 104 sets the opening amount of the shutter 53 to 0 mm and thereby closes the shutter 53. The motor driving section 111 drives the motor 56 so that the opening amount becomes 0 mm. Thereby, a configuration is such that the ambient temperature C(t) tends to rise.

In step S1103, the CPU 104 sets the target temperature of the fixing apparatus 13 to 180° C., and starts supply of power to the fixing heater 30.

In step S1104, the CPU 104 uses the determination formula Td to determine whether or not the combination of the ambient temperature C(t) obtained by the temperature prediction section 121 and the UFP discharge amount Us(t) obtained by the UFP prediction section 122 is present in the first mode region a. The CPU 104 waits until the combination of C(t) and Us(t) becomes positioned in the first mode region a. When the combination of C(t) and Us(t) becomes positioned in the first mode region a, the process advances to step S1105.

In step S1105, the CPU 104 starts printing (image formation operation).

Experimental Results

Figure 11B:
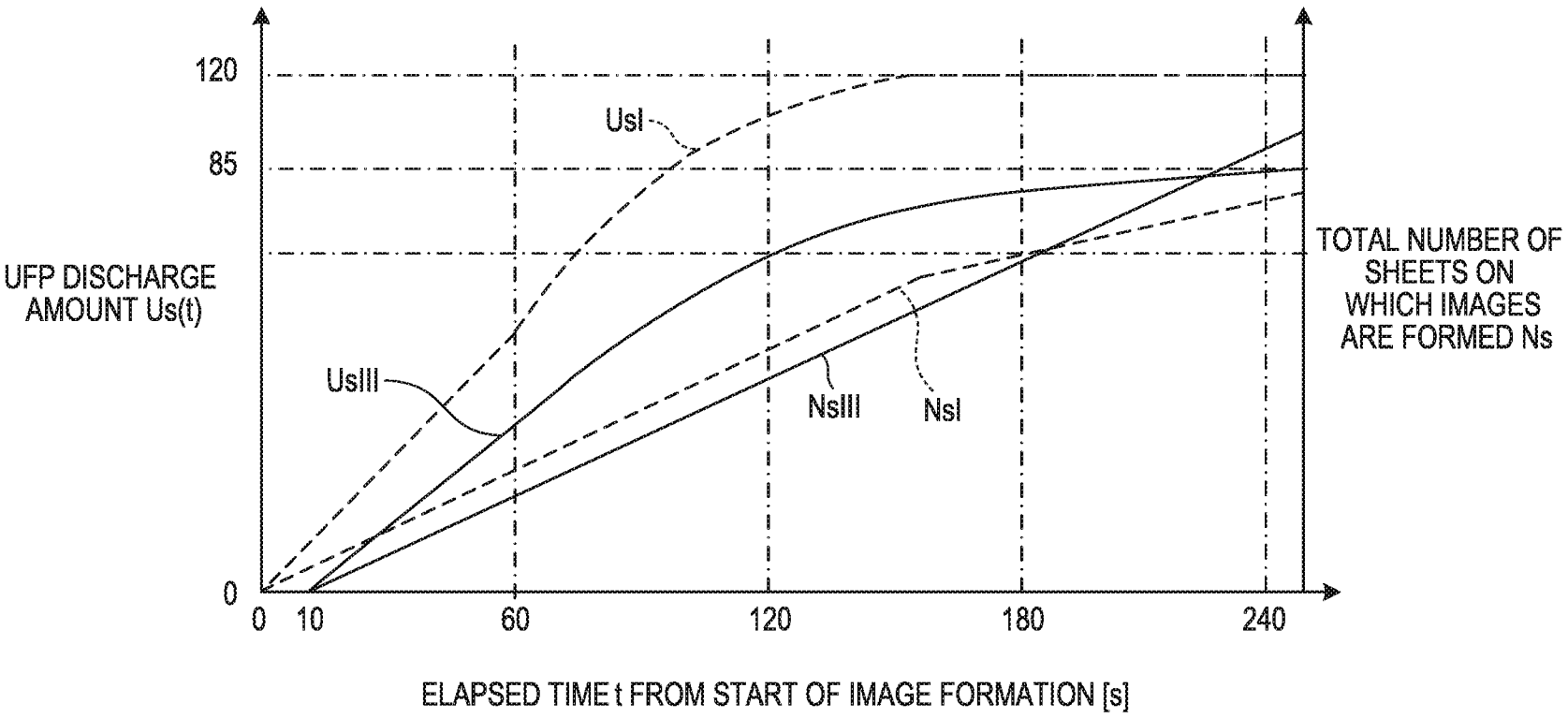
FIG. 11B is a view illustrating experimental results.

FIG. 11B illustrates experimental results for the first embodiment and the third embodiment for the case in which the image formation operation is performed under the same conditions. UsIII is the amount of UFP discharge according to the third embodiment. NsIII is the total number of sheets to which images are formed according to the third embodiment. The experimental results for the first embodiment are as was already described using FIG. 10. In the third embodiment, at 0 seconds, the determination result of the determination formula Td falls in the second mode region. Accordingly, the CPU 104 closes the shutter 53 and temperature control for the fixing heater 30 is started. Thereby, the ambient temperature C(t) starts to rise. At the point in time when approximately 10 seconds has elapsed, the determination result of the determination formula Td transitions into the first mode region a. Accordingly, the image formation operation is started. Because the image formation operation is started in a state in which the determination result of the determination formula Td has transitioned into the first mode region a, the UFP discharge amount Us converges at a low value. Specifically, in the third embodiment, since reduction of the UFP discharge amount by lowering of the conveyance speed is not performed, high productivity is maintained. When the total number of sheets subjected to image formation NsIII exceeds 180 sheets (at the point in time when approximately 190 seconds has elapsed), the productivity of the third embodiment exceeds the productivity of the first embodiment. After that, the productivity of the third embodiment is greater than the productivity of the first embodiment. Accordingly, in the case in which the number of sheets on which images are to be formed is large, the third embodiment is advantageous in that the UFP discharge amount Us is reduced and high productivity can be achieved.

Also, the determination formula Td may be a simple formula for determining by using only the ambient temperature C. For example, the first mode region a is determined if the ambient temperature C is 85° C. or more and the second mode region is determined otherwise.

In this way, in the third embodiment, in a case in which the image formation operation is started in a state in which the UFP discharge amount Us is large, the image formation operation is started after raising the ambient temperature C(t) in advance. Accordingly, since a reduction in the conveyance speed does not occur, the UFP discharge amount Us is reduced and high productivity is achieved.

Conclusion

The fixing apparatus 13 functions as a fixing device that, by adding heat and pressure to a toner image formed on a sheet S, fixes the toner image to the sheet S. The temperature sensor 32 functions as a temperature sensor that detects a temperature of an end of the fixing roller 14 in a direction perpendicular to a sheet conveyance direction. The cooling mechanism 50 functions as a cooling device that cools the end of the fixing roller 14. The cooling control section 120 functions as a cooling controller that controls a cooling level by the cooling mechanism 50 in accordance with the temperature of the end of the fixing roller 14 detected by the temperature sensor 32. The cooling level is a term that can be substituted with the control state of the cooling mechanism 50. The temperature prediction section 121 functions as an obtaining unit that obtains the ambient temperature C(t) of the fixing apparatus 13 based on an environmental temperature of the environment in which the image forming apparatus 100 is installed or an initial value based on the ambient temperature of the previous time and an operation time of the image forming apparatus 100. The ambient temperature of the previous time is an ambient temperature obtained when the power of the image forming apparatus 100 is off or the image forming apparatus 100 transitions into an energy saving mode. For example, the power of the image forming apparatus 100 being turned off and on prior to the ambient temperature decreasing to the environmental temperature can be considered. In such a case, the ambient temperature when the power of the image forming apparatus 100 was turned on is closer to the ambient temperature predicted the previous time than the environmental temperature. In such a case, the ambient temperature C(t) may be predicted based on the ambient temperature predicted the previous time and the elapsed time (operation time) from when the power was turned on. The UFP prediction section 122 functions as a prediction unit that, based on a parameter depending on at least one of the cooling level and the ambient temperature C(t), predicts the discharge amount Us(t) of ultra fine particles that are discharged from the image forming apparatus 100. Note that the temperature prediction section 121 may predict the ambient temperature C(t) based on the cooling level. The UFP control section 123 functions as an image formation controller that controls an image forming operation by the image forming apparatus 100 such that a discharge amount of ultra fine particles is reduced in accordance with the discharge amount Us(t). By virtue of the embodiments, the prediction accuracy of the UFP discharge amount Us(t) improves since at least the cooling level is taken into consideration.

The cooling fan 51 and the duct 52, or the like, function as a blower unit that supplies air to the end of the fixing roller 14. The UFP prediction section 122 may predict the discharge amount Us(t) for ultra fine particles by using the air flow amount y of the cooling fan 51 as the parameter depending on the cooling level. The cooling mechanism 50 may further comprise the shutter 53 that is provided at the exit of the duct 52 and can be opened and closed. The UFP prediction section 122 may predict the discharge amount by using the opening amount x of the shutter 53 as the parameter depending on the cooling level.

The Rx determination section 135 is one example of a first determination unit that determines a first discharge coefficient (for example: discharge ratio Rx) based on the air flow amount y and the opening amount x. The UFP prediction section 122 may predict the discharge amount by using the first discharge coefficient as the parameter depending on the cooling level. The Rc determination section 134 is one example of a second determination unit that determines a second discharge coefficient (for example: discharge ratio Rc) based on the ambient temperature C(t). The UFP prediction section 122 may predict the discharge amount by using the second discharge coefficient as the parameter depending on the ambient temperature C(t). The UFP prediction section 122 may predict the discharge amount based on the number of sheets subjected to image formation per unit time N in addition to these parameters. According to Formula (2), Rx, Rc, and N are all used, but a configuration may be such that one or more of these is used.

The temperature prediction section 121 may be configured to obtain the ambient temperature C(t) at regular intervals. The temperature prediction section 121 may obtain the ambient temperature C(t) by multiplying the temperature coefficient k with the difference between the convergence temperature Cx obtained based on the opening amount x of the shutter 53 and the ambient temperature C(t−1) obtained the previous time, and then adding the ambient temperature C(t−1) thereto.

The k determination section 131 may function as a selection unit that selects a first temperature coefficient (for example: k1) if the ambient temperature C(t−1) is exceeding the convergence temperature Cx. Also, the k determination section 131 may function as a selection unit that selects a second temperature coefficient (for example: k2) that is less than the first temperature coefficient if the ambient temperature C(t−1) is not exceeding the convergence temperature Cx, and passes it to the temperature prediction section 121.

The UFP control section 123 may reduce the discharge amount Us by controlling the conveyance speed of the sheets S conveyed through the fixing apparatus 13 in accordance with the discharge amount Us. Note that the target temperature of the fixing apparatus 13 decreases when the conveyance speed decreases.

As described in the second embodiment, the UFP control section 123 may have a first mode, in which the discharge amount Us is reduced by controlling the conveyance speed of the sheets S, and a second mode, in which the discharge amount Us is reduced by controlling the conveyance interval of the sheets S. The UFP control section 123, based on at least one of the ambient temperature C(t) and the discharge amount Us(t) of ultra fine particles predicted by the UFP prediction section 122, selects one of the first mode and the second mode. When the second mode is selected, the cooling mechanism 50 stops. Thereby, the discharge amount Us(t) is reduced. The UFP control section 123 may select the second mode when at least one of the ambient temperature C(t) and the discharge amount Us(t) predicted by the UFP prediction section 122 satisfies a predetermined condition, and the cooling level is a predetermined level or more. The UFP control section 123 may select the second mode when at least one of the discharge amount Us(t) and the ambient temperature C(t) satisfies a predetermined condition and the cooling level is a predetermined level or more, and the number of remaining sheets on which the image formation operation is to be performed is a predetermined number or more.

As described in the third embodiment, when a print job is input into the image forming apparatus 100, there are cases in which at least one of the ambient temperature C(t) and the discharge amount Us(t) predicted by the UFP prediction section 122 does not satisfy the predetermined condition. In such a case, the UFP control section 123 may heat the fixing apparatus 13 until at least one of the discharge amount Us(t) and the ambient temperature C(t) satisfies the predetermined condition. Thereby, the amount of UFP discharge is reduced.

Other Embodiments

Embodiments of the present invention can also be realized by a computer of a system or an apparatus that reads out and executes computer executable instructions (e.g., one or more programs) recorded on a storage medium (which may also be referred to more fully as a 'non-transitory computer-readable storage medium') to perform the functions of one or more of the above-described embodiments and/or that includes one or more circuits (e.g., an application specific integrated circuit (ASIC)) for performing the functions of one or more of the above-described embodiments, and by a method performed by the computer of the system or the apparatus by, for example, reading out and executing the computer executable instructions from the storage medium to perform the functions of one or more of the above-described embodiments and/or controlling the one or more circuits to perform the functions of one or more of the above-described embodiments. The computer may comprise one or more processors (e.g., a central processing unit (CPU), or a micro processing unit (MPU)) and may include a network of separate computers or separate processors to read out and to execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), a digital versatile disc (DVD), or a Blu-ray Disc (BD)™) a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

The invention claimed is:

1. An image forming apparatus comprising:

(A) a fixing device configured to fix, by adding heat and pressure to a toner image formed on a sheet, the toner image to the sheet;

(B) a temperature sensor configured to detect a temperature of an end of the fixing device in a direction perpendicular to a sheet conveyance direction;

(C) a cooling fan configured to supply air to the end of the fixing device to cool the end of the fixing device;

(D) a processor circuit configured:

(a) to control a cooling level by the cooling fan in accordance with the temperature of the end of the fixing device detected by the temperature sensor;

(b) to predict, based on at least one parameter depending on the cooling level, a discharge amount of ultra fine particles that are discharged from the image forming apparatus; and (c) to control an image forming operation by the image forming apparatus such that the discharge amount of ultra fine particles is reduced in accordance with the discharge amount predicted by the processor circuit; and (E) a shutter provided at an exit of the cooling fan, and configured to be opened and closed, wherein the processor circuit predicts the discharge amount of ultra fine particles by using an air flow amount of the cooling fan and an opening amount of the shutter as parameters depending on the cooling level.

2. The image forming apparatus according to claim 1, wherein the processor circuit predicts the discharge amount for ultra fine particles by using an air flow amount of the cooling fan as a parameter depending on the cooling level.

3. The image forming apparatus according to claim 1, further comprising (E) a shutter provided at an exit of the cooling fan, and configured to be opened and closed, wherein the processor circuit predicts the discharge amount for ultra fine particles by using an opening amount of the shutter as a parameter depending on the cooling level.

4. The image forming apparatus according to claim 1, wherein the processor circuit predicts the discharge amount of ultra fine particles from the image forming apparatus based on a number of sheets subjected to image formation per unit time, in addition to the parameter.

5. The image forming apparatus according to claim 1, wherein the processor circuit reduces the discharge amount of ultra fine particles by controlling a conveyance speed of a sheet conveyed through the fixing device in accordance with the discharge amount predicted by the processor circuit.

6. An image forming apparatus comprising:

(A) a fixing device configured to fix, by adding heat and pressure to a toner image formed on a sheet, the toner image to the sheet;

(B) a temperature sensor configured to detect a temperature of an end of the fixing device in a direction perpendicular to a sheet conveyance direction;

(C) a cooling fan configured to supply air to the end of the fixing device to cool the end of the fixing device;

(D) a shutter provided at an exit of the cooling fan, and configured to be opened and closed; and (E) a processor circuit configured:

(a) to control a cooling level by the cooling fan in accordance with the temperature of the end of the fixing device detected by the temperature sensor;

(b) to predict an ambient temperature of the fixing device based on the cooling level, wherein the processor circuit predicts the ambient temperature at regular intervals, and is configured to predict the ambient temperature of the fixing device by multiplying a temperature coefficient by a difference between a convergence temperature, obtained based on an opening amount of the shutter, and a predicted ambient temperature for a previous interval, which is a set initial ambient temperature and is replaced by the predicted ambient temperature for each subsequent interval, and then adding the predicted ambient temperature for the previous interval;

(c) to predict, based on the ambient temperature, a discharge amount of ultra fine particles that are discharged from the image forming apparatus; and (d) to control an image forming operation by the image forming apparatus such that the discharge amount of ultra fine particles is reduced in accordance with the discharge amount predicted by the processor circuit.

7. The image forming apparatus according to claim 6, wherein the processor circuit is further configured:

(e) to select a first temperature coefficient if the previously obtained ambient temperature exceeds the convergence temperature; and (f) to select a second temperature coefficient that is less than the first temperature coefficient if the previously obtained ambient temperature does not exceed the convergence temperature, wherein the processor circuit uses the selected temperature coefficient to obtain the ambient temperature of the fixing device.

8. An image forming apparatus comprising:

(A) a fixing device configured to fix, by adding heat and pressure to a toner image formed on a sheet, the toner image to the sheet;

(B) a temperature sensor configured to detect a temperature of an end of the fixing device in a direction perpendicular to a sheet conveyance direction;

(C) a cooling fan configured to supply air to the end of the fixing device to cool the end of the fixing device; and (D) a processor circuit configured:

(a) to control a cooling level by the cooling fan in accordance with the temperature of the end of the fixing device detected by the temperature sensor;

(b) to obtain an ambient temperature of the fixing device based on the cooling level;

(c) to predict, based on the ambient temperature, a discharge amount of ultra fine particles that are discharged from the image forming apparatus; and (d) to control an image forming operation by the image forming apparatus such that the discharge amount of ultra fine particles is reduced in accordance with the discharge amount predicted by the processor circuit, wherein the processor circuit is configured to operate in a first mode, in which the discharge amount of ultra fine particles is reduced by controlling a conveyance speed of a sheet, and a second mode, in which the discharge amount of ultra fine particles is reduced by controlling a conveyance interval of two adjacent sheets, and, based on at least one of the ambient temperature and the discharge amount of ultra fine particles predicted by the processor circuit, the processor circuit selects one of the first mode and the second mode.

9. The image forming apparatus according to claim 8, wherein, when the second mode is selected, the cooling fan stops.

10. The image forming apparatus according to claim 8, wherein the processor circuit selects the second mode when at least one of the ambient temperature and the discharge amount of ultra fine particles predicted by the processor circuit satisfies a predetermined condition, and the cooling level of the cooling fan is a predetermined level or more.

11. The image forming apparatus according to claim 8, wherein the processor circuit selects the second mode when at least one of the ambient temperature and the discharge amount of ultra fine particles predicted by the processor circuit satisfies a predetermined condition, and the cooling level of the cooling fan is a predetermined level or more, and a number of remaining sheets in a print job input into the image forming apparatus, to which image formation is to be performed, is a predetermined number or more.

12. The image forming apparatus according to claim 8, wherein, when a print job is input into the image forming apparatus, if at least the ambient temperature, out of the discharge amount of ultra fine particles predicted by the processor circuit and the ambient temperature, does not satisfy a predetermined condition, the processor circuit causes the fixing device to generate heat until at least the ambient temperature, out of the discharge amount of ultra fine particles predicted by the processor circuit and the ambient temperature, satisfies the predetermined condition.

13. A method of controlling an image forming apparatus comprising a fixing device configured to fix, by adding heat and pressure to a toner image formed on a sheet, the toner image to the sheet, a temperature sensor configured to detect a temperature of an end of the fixing device in a direction perpendicular to a sheet conveyance direction, a cooling fan configured to supply air to the end of the fixing device to cool the end of the fixing device, and a shutter provided at an exit of the cooling fan, the shutter being configured to be opened and closed, the method comprising:

controlling a cooling level by the cooling fan in accordance with the temperature of the end of the fixing device detected by the temperature sensor;

predicting, based on at least one parameter depending on the cooling level, a discharge amount of ultra fine particles that are discharged from the image forming apparatus, thereby producing a predicted discharge amount; and controlling an image forming operation by the image forming apparatus such that the discharge amount of ultra fine particles is reduced in accordance with the predicted discharge amount, wherein the predicting comprises predicting the discharge amount of ultra fine particles by using an air flow amount of the cooling fan and an opening amount of the shutter as parameters depending on the cooling level.

* * * * *